US012551008B2

(12) United States Patent
Olander

(10) Patent No.: US 12,551,008 B2
(45) Date of Patent: Feb. 17, 2026

(54) STAND FOR SUPPORTING A COMPUTING DEVICE

(71) Applicant: Roost Industries Corp., Aurora, CO (US)

(72) Inventor: James Dotson Olander, Denver, CO (US)

(73) Assignee: ROOST INDUSTRIES CORP., Denver, CO (US)

( * ) Notice: Subject to any disclaimer, the term of this patent is extended or adjusted under 35 U.S.C. 154(b) by 7 days.

(21) Appl. No.: 18/346,787

(22) Filed: Jul. 4, 2023

(65) Prior Publication Data

US 2023/0404256 A1 Dec. 21, 2023

Related U.S. Application Data

(63) Continuation-in-part of application No. 29/877,456, filed on Jun. 7, 2023, now abandoned, and a continuation-in-part of application No. 17/817,224, filed on Aug. 3, 2022, now Pat. No. 11,690,445, which is a continuation of application No. 17/367,780, filed on Jul. 6, 2021, now Pat. No. 11,406,183, which is a continuation-in-part of application No. 29/797,937, filed on Jul. 4, 2021, now Pat. No. Des. 1,016,821.

(51) Int. Cl.
*A47B 23/00* (2006.01)
*A47B 23/04* (2006.01)

(52) U.S. Cl.
CPC ..... *A47B 23/043* (2013.01); *A47B 2023/049* (2013.01)

(58) Field of Classification Search
None
See application file for complete search history.

(56) References Cited

U.S. PATENT DOCUMENTS

| | | | |
|---|---|---|---|
| 677,216 | A | 6/1901 | Huebner |
| 929,989 | A | 8/1909 | Sharp |
| 1,837,826 | A | 12/1931 | Mitchell |
| 1,838,856 | A | 12/1931 | Mitchell |
| 1,840,620 | A | 1/1932 | Dennis |
| 2,373,617 | A | 4/1945 | Tiryakian |
| 2,441,932 | A | 5/1948 | Curry |

(Continued)

FOREIGN PATENT DOCUMENTS

| | | |
|---|---|---|
| CN | 101604187 | 12/2009 |
| CN | 101701660 | 5/2010 |

(Continued)

OTHER PUBLICATIONS

Wayback Machine, Human Solutions online brochure, http://web.archive.org/web/20130818085003/http://www.thehumansolution.com/innovativecricket-portable-laptop-pc-stand.html, 4 pages, retrieved on Apr. 14, 2014.

(Continued)

*Primary Examiner* — Steven M Marsh
(74) *Attorney, Agent, or Firm* — FisherBroyles, LLP; Craig W. Mueller

(57) ABSTRACT

A stand for supporting a computing device is provided. The stand may support the computing device at a height such that a screen of the computing device is capable of being at or near eye-level of a user. The stand may include a frame member and a gripping mechanism attached to an end of the frame member. The gripping mechanism may secure the computing device to the stand.

16 Claims, 40 Drawing Sheets

(56) References Cited

U.S. PATENT DOCUMENTS

| | | | |
|---|---|---|---|
| 2,694,442 | A | 11/1954 | Nordmark |
| 2,722,972 | A | 11/1955 | Altruda |
| 3,899,164 | A | 8/1975 | Newman |
| 3,991,967 | A | 11/1976 | Sack |
| 3,995,882 | A | 12/1976 | Watkins |
| 4,118,065 | A | 10/1978 | Watkins |
| 4,714,224 | A | 12/1987 | Calmes |
| 4,726,556 | A | 2/1988 | Weir |
| 5,129,616 | A | 7/1992 | Carson |
| 5,149,046 | A | 9/1992 | Kerley |
| 5,308,035 | A | 5/1994 | Ross |
| 5,388,852 | A | 2/1995 | Bigo |
| 5,492,299 | A | 2/1996 | Thermos et al. |
| 5,651,525 | A | 7/1997 | Yang |
| 5,794,639 | A | 8/1998 | Einbinder |
| 5,797,578 | A | 8/1998 | Graffeo et al. |
| 5,833,178 | A | 11/1998 | Plasse et al. |
| 5,845,889 | A | 12/1998 | Suzuki |
| 6,006,580 | A | 12/1999 | Frawley |
| 6,073,894 | A | 6/2000 | Chen |
| 6,076,787 | A | 6/2000 | Troyer |
| 6,244,011 | B1 | 6/2001 | Esser |
| 6,260,486 | B1 | 7/2001 | Boos et al. |
| 6,382,716 | B1 | 5/2002 | Wu |
| 6,488,331 | B2 | 12/2002 | Chen |
| 6,634,304 | B2 | 10/2003 | Wang |
| 6,666,223 | B2 | 12/2003 | Price et al. |
| 6,676,100 | B2 | 1/2004 | Hsu |
| 6,792,880 | B2 | 9/2004 | Tsai |
| 6,944,012 | B2 | 9/2005 | Doczy et al. |
| 7,066,438 | B2 | 6/2006 | Ma |
| 7,108,275 | B2 | 9/2006 | Yeh |
| 7,229,128 | B2 | 6/2007 | Lee |
| D562,572 | S | 2/2008 | Nothel |
| 7,637,468 | B2 | 12/2009 | Huang |
| 7,712,719 | B2 | 5/2010 | Derry |
| 7,717,502 | B2 | 5/2010 | Deng |
| 7,748,667 | B1 | 7/2010 | Bartholomew |
| D634,311 | S | 3/2011 | Stifal |
| 8,020,818 | B2 | 9/2011 | Chou |
| 8,172,191 | B1 | 5/2012 | Zimbalatti |
| D668,256 | S | 10/2012 | Matteo |
| D669,482 | S | 10/2012 | Hu |
| D672,782 | S | 12/2012 | Gross |
| D677,262 | S | 3/2013 | Lewis |
| D689,500 | S | 9/2013 | Faulk |
| 8,534,619 | B2 | 9/2013 | Huang et al. |
| D694,761 | S | 12/2013 | Zoll |
| D696,261 | S | 12/2013 | Weldon |
| D701,212 | S | 3/2014 | Blevins |
| 8,708,298 | B2 | 4/2014 | Hu |
| D704,195 | S | 5/2014 | Marquette |
| D704,714 | S | 5/2014 | Christiano |
| D714,281 | S | 9/2014 | Reznik |
| 8,899,543 | B2 | 12/2014 | Liang |
| 9,097,481 | B2 | 8/2015 | Chaney |
| 9,104,372 | B2 | 8/2015 | Frenzel |
| 9,211,001 | B2 | 12/2015 | Negretti |
| D750,088 | S | 2/2016 | Reznik |
| D757,019 | S | 5/2016 | Pitteri |
| D764,478 | S | 8/2016 | Radmard |
| D770,460 | S | 11/2016 | Won |
| 9,482,383 | B1 | 11/2016 | Wei |
| D783,628 | S | 4/2017 | Pitteri |
| 9,625,081 | B2 | 4/2017 | Olander |
| D792,417 | S | 7/2017 | Xiang |
| 9,828,221 | B2 | 11/2017 | Mohr |
| 9,894,988 | B2 | 2/2018 | Olander |
| D827,652 | S | 9/2018 | Jacques |
| D829,216 | S | 9/2018 | Belitz |
| 10,070,719 | B2 | 9/2018 | Olander |
| 10,098,452 | B2 | 10/2018 | Ko |
| 10,113,684 | B2 | 10/2018 | Hou |
| D832,726 | S | 11/2018 | Kim |
| D838,724 | S | 1/2019 | Olander |
| D860,216 | S | 9/2019 | Olander |
| 2003/0111582 | A1 | 6/2003 | Bakker |
| 2004/0084581 | A1 | 5/2004 | Chang |
| 2005/0103969 | A1 | 5/2005 | Gaines |
| 2006/0054753 | A1 | 3/2006 | Lee |
| 2006/0108494 | A1 | 5/2006 | Lancet |
| 2008/0054149 | A1 | 3/2008 | Freebairn |
| 2008/0067315 | A1 | 3/2008 | Zhang |
| 2008/0224515 | A1 | 9/2008 | Cui |
| 2008/0251659 | A1 | 10/2008 | Matias |
| 2008/0301927 | A1 | 12/2008 | Miller |
| 2009/0045304 | A1 | 2/2009 | Faifer |
| 2009/0179132 | A1 | 7/2009 | Qin |
| 2009/0241811 | A1 | 10/2009 | Markegard |
| 2010/0213330 | A1 | 8/2010 | Downing |
| 2010/0276560 | A1 | 11/2010 | Farris-Gilbert |
| 2011/0149510 | A1 | 6/2011 | Monsalve |
| 2011/0226916 | A1 | 9/2011 | Leung |
| 2011/0227373 | A1 | 9/2011 | Cone, II |
| 2012/0145835 | A1 | 6/2012 | Zaharakis |
| 2012/0210912 | A1 | 8/2012 | Florendo |
| 2013/0001379 | A1 | 1/2013 | Hobbs |
| 2013/0048801 | A1 | 2/2013 | Weinberg |
| 2013/0175421 | A1 | 7/2013 | Faulk |
| 2013/0277529 | A1 | 10/2013 | Bolliger |
| 2013/0286323 | A1 | 10/2013 | Kuo |
| 2014/0110556 | A1 | 4/2014 | Mao |
| 2014/0124631 | A1 | 5/2014 | Olander |
| 2016/0138753 | A1 | 5/2016 | Crossland |
| 2018/0125229 | A1 | 5/2018 | Olander |
| 2018/0192770 | A1 | 7/2018 | Lu |
| 2018/0252353 | A1 | 9/2018 | Hou |

FOREIGN PATENT DOCUMENTS

| | | |
|---|---|---|
| CN | 201535421 | 7/2010 |
| CN | 102748568 | 10/2012 |
| CN | 202691496 | 1/2013 |
| WO | WO2009135402 | 12/2009 |
| WO | WO2010040754 | 4/2010 |
| WO | WO2014071064 | 5/2014 |

OTHER PUBLICATIONS

Foldable Aluminum Laptop Stand for Desk Bed Table Floor, Ergonomic Multiple Portable Adjustable Notebook Computer Laptop Holder for Home Office. https://www.primesmartstore.com/product/foldable-aluminum-laptop-stand-for-desk-bed-table-floor-ergonomic-multiple-portable-adjustable-notebook-computer-laptop-holder-for-home-office/. 3 pages.

Non-final Office Action from parent U.S. Appl. No. 17/367,780, filed Nov. 26, 2021. 18 pages.

International Search Report and Written Opinion from related PCT/US2022/073205. Jul. 26, 2022. 9 pages.

International Search Report for International Application No. PCT/US2013/067856, dated Mar. 28, 2014, 3 pages.

Written Opinion for International Application No. PCT/US2013/067856, dated Mar. 28, 2014, 5 pages.

Nexstand K2 Manual, accessed from http://www.nexstand.com/ believed to be active since Jun. 2016. 2 pages.

(Closed Configuration)

(Open Configuration)

STAND FOR SUPPORTING A COMPUTING DEVICE

This application is a continuation-in-part of U.S. patent application Ser. No. 17/817,224, filed Aug. 3, 2022, now U.S. Pat. No. 11,690,445, which is a continuation of U.S. patent application Ser. No. 17/367,780, filed Jul. 6, 2021, now U.S. Pat. No. 11,406,183, which is a continuation-in-part of U.S. patent application Ser. No. 29/797,937, filed Jul. 4, 2021, the entirety of which are incorporated by reference herein.

This application is a continuation-in-part of U.S. patent application Ser. No. 29/877,456, filed Jun. 7, 2023, the entirety of which is incorporated by reference herein.

This application is related to U.S. Pat. Nos. 9,625,081, 9,894,988, 10,070,719, D838,724, and D860,216, the entireties of which are incorporated by reference herein.

FIELD OF THE INVENTION

Embodiments of the present invention are generally related to a stand for supporting a computing device, such as a laptop computer.

BACKGROUND OF THE INVENTION

The prevalence of repetitive use injuries from consumer electronics is continually increasing amongst technology users. For example, when situated on a desk or table, a laptop computer has a screen positioned typically one to three feet lower than eye level. This positioning arrangement forces a head-down user posture that is dangerous for extended sessions at the laptop computer and contributes greatly to computer-related repetitive use injuries.

SUMMARY OF THE INVENTION

It is one aspect of some embodiments of the present invention to provide a stand for positioning a mobile computing device at an elevated position. When used in association with a laptop computer, the stand elevates a laptop computer screen to near eye level so that a user may maintain a more ergonomically correct working position, thereby reducing repetitive use injuries from using the laptop computer. The stand may be portable, allowing a user to work at remote locations away from their home or office in a more ergonomically correct position. The stand of embodiment is made without pins.

In one example, a collapsible stand for use with a mobile computing device is provided. The stand may include a first side frame structure, a second side frame structure, and a cross frame structure interconnecting the first and second side-frame structures. The cross frame structure of one embodiment is operably coupled to the first and second side-frame structures such that the first and second side-frame structures are oriented parallel or substantially parallel to one another as the stand is moved from a fully extended to a collapsed position.

The first and second side frame structures include an elongate arm with an upper arm configured to engage the laptop's screen and a leg rotatably attached to the arm such that the leg rotates and slides relative to the arm. Gripping mechanisms are attached to ends of the legs that are configured to grasp and secure the lower edge of the laptop such that the laptop is suspended from its bottom edge.

The first and second side frame structures may include a cross link pivotally attached at one end to the arm and pivotally attached at another end to the leg. The first and second side frame structures may include a height adjustment mechanism to the arm to prevent the leg's gripping mechanism from moving beyond a predetermined point.

The cross frame structure may include a pair of elongate, offset cross frame members pivotally attached at lower ends to lower ends of the arms of the first and second side frame structures and pivotally attached at upper ends to the legs of the first and second side frame structures. The cross frame members may be pivotally attached intermediate their respective ends.

The upper ends of the cross frame members may be slidably attached to the first and second side frame structures such that the upper ends of the cross frame members move away from the lower ends of the arms when the stand is transitioned from an extended position to a collapsed position. When the stand is in the extended position, the upper ends of the cross frame members may be lockable relative to the lower ends of the arms to prevent or substantially prevent the stand from expanding beyond a predetermined width.

It is another aspect of embodiments of the present invention to provide a case adapted to store a collapsible stand of the type described in the patents and patent applications mentioned above or other types of collapsible stands. Because the stand also elevates the laptop's interconnected keyboard, a secondary keyboard often must be used. Accordingly, the case can also convert into a wrist rest. The wrist rest helps ensure the user's wrists and hands are properly oriented. In operation, the stand and wrist rest comprise a system that will maximize user comfort and reduce the aforementioned strain.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present invention are possible utilizing, alone or in combination, as set forth above and/or described in the accompanying figures and/or in the description herein below.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and drawing figures are to be understood as being approximations which may be modified in all instances as required for a particular application of the novel assembly and method described herein.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description and in the appended drawing figures.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
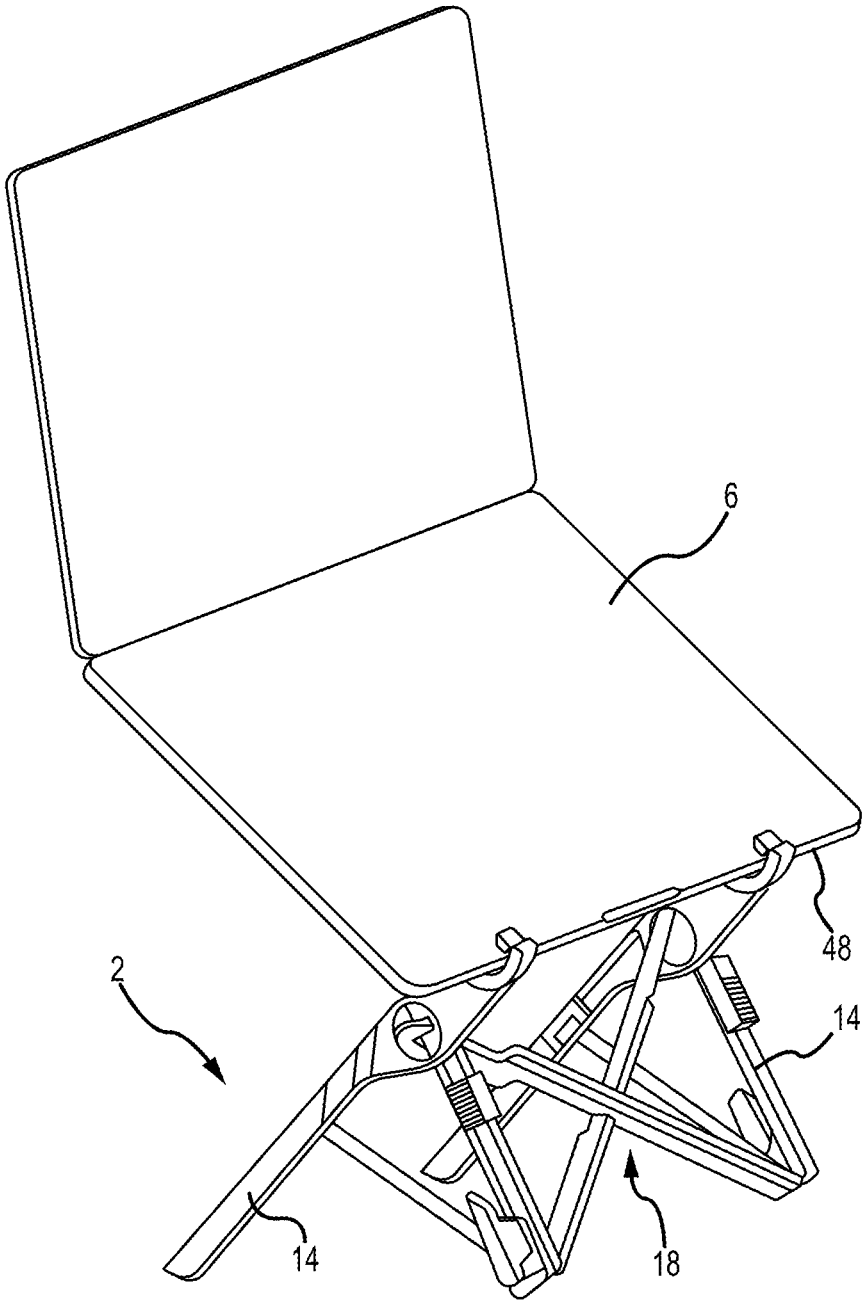
FIG. 1 is a perspective view showing a collapsible stand for supporting a laptop computer or similar device of one embodiment of the present invention.
Figure 2:
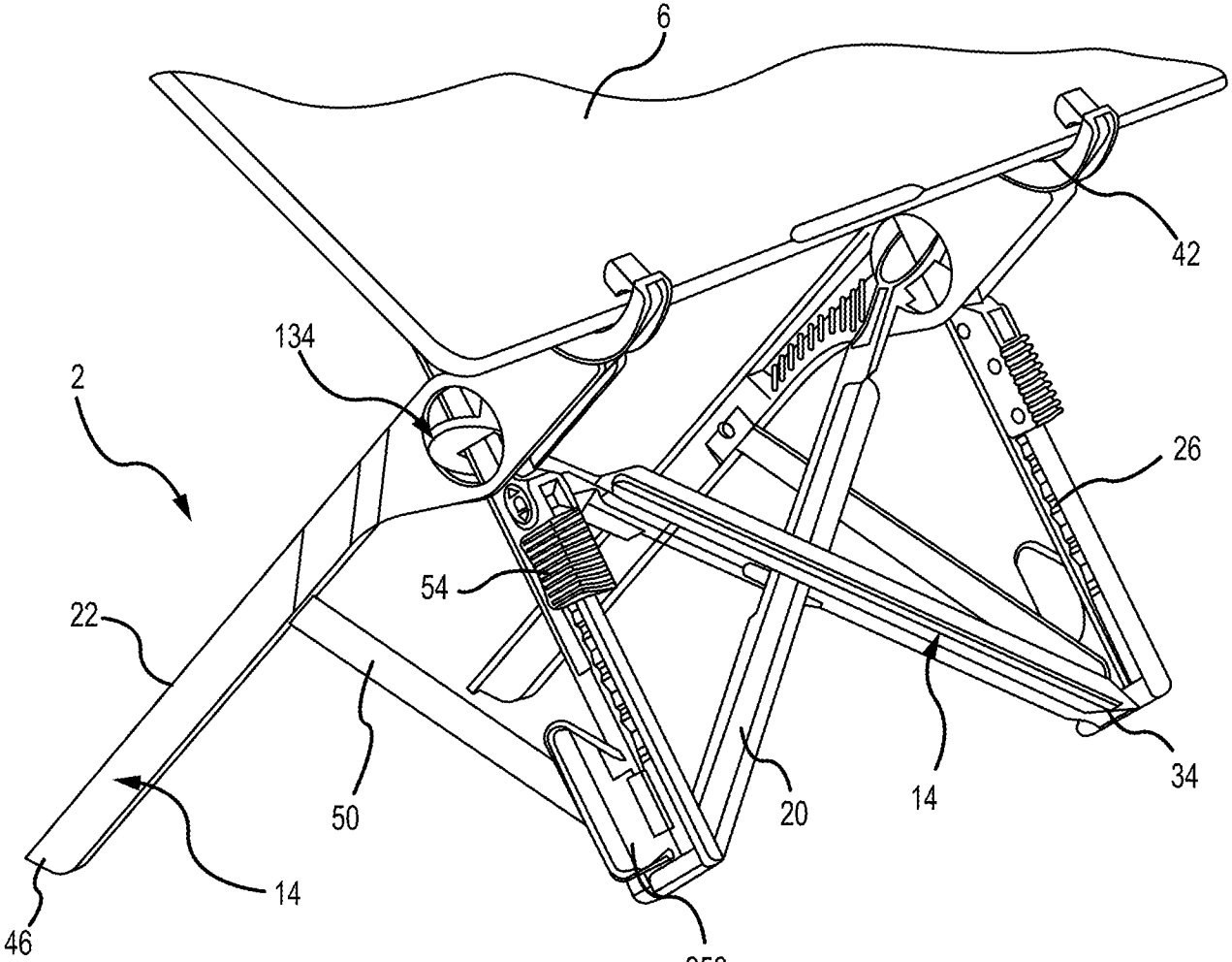
FIG. 2 is a detailed view of FIG. 1.
Figure 3:
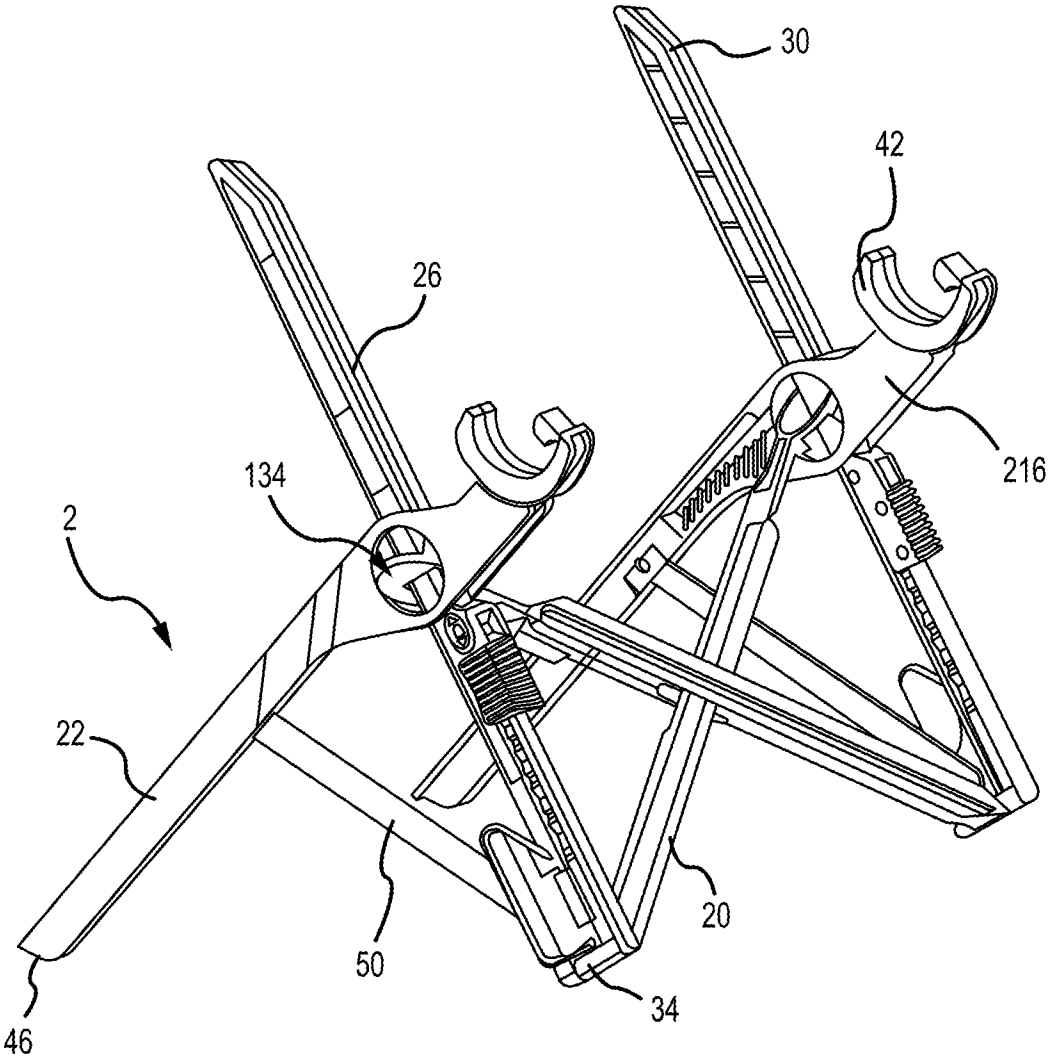
FIG. 3 is a perspective view of the stand of FIG. 1.

The following component list and associated numbering found in the drawings is provided to assist in the understanding of one embodiment of the present invention:

| # | Component |
|---|---|
| 2 | Stand |
| 6 | Laptop computer |
| 14 | Side frame structure |
| 18 | Cross frame structure |
| 20 | Cross frame member |
| 22 | Leg |
| 26 | Arm |
| 30 | Engagement surface |
| 34 | Base segment |
| 42 | Gripping mechanism |
| 46 | Foot |
| 48 | Front edge |
| 50 | Cross link |
| 54 | Height adjustment mechanism |
| 58 | Flat surface |
| 62 | Lock |
| 66 | Carrier |
| 70 | Channel |
| 74 | Teeth |
| 78 | Locking protrusion |
| 82 | Lock arm |
| 86 | Lateral side surface |
| 90 | Longitudinal cavity |
| 94 | Finger |
| 98 | Body portion |
| 102 | Protrusion |
| 104 | Stop |
| 106 | Upper surface |
| 110 | Inwardly-facing surface |
| 114 | Outwardly-facing surface |
| 118 | Locking space |
| 122 | Thumb/finger pad |
| 124 | Detent |
| 125 | Cavity |
| 126 | Head |
| 130 | Socket |
| 134 | Slider mechanism |
| 138 | Longitudinal opening |
| 142 | Head opening |
| 164 | Longitudinal groove |
| 168 | Rotating member |
| 172 | Band |
| 174 | Channel |
| 176 | Nub |
| 184 | Finger |
| 188 | Pin |
| 192 | Retainer |
| 196 | Boss |
| 200 | Opening |
| 204 | Pin |
| 208 | Rib |
| 212 | Rib |
| 216 | Leg upper end |

-continued

| # | Component |
|---|---|
| 220 | Outer surface |
| 224 | Inner sidewall |
| 228 | Outer sidewall |
| 230 | Ledge |
| 234 | Inner surface |
| 238 | Cavity |
| 250 | Pull tab |
| 252 | Spring |
| 254 | Outer surface |
| 258 | Hub |
| 262 | Removable pull tab |
| 266 | Tab portion |
| 270 | Gripping member |
| 274 | Finger |
| 1002 | Stand |
| 1022 | Leg |
| 1026 | Arm |
| 1034 | Base segment |
| 1042 | Gripping mechanism |
| 1054 | Height adjustment mechanism |
| 1500 | Spring |
| 1504 | Sidewall |
| 1508 | Cavity |
| 1512 | Upper Surface |
| 1516 | Finger groove |
| 1520 | Upper portion |
| 1524 | Channel |
| 2002 | Stand |
| 2006 | Laptop computer |
| 2014 | Side frame structure |
| 2018 | Cross frame structure |
| 2020 | Cross frame member |
| 2022 | Leg |
| 2026 | Arm |
| 2030 | Engagement surface |
| 2034 | Base segment |
| 2042 | Gripping mechanism |
| 2050 | Cross link |
| 2054 | Height adjustment mechanism |
| 2058 | Flat surface |
| 2062 | Lock |
| 2066 | Carrier |
| 2070 | Channel |
| 2074 | Teeth |
| 2078 | Locking protrusion |
| 2086 | Cavity |
| 5002 | Case |
| 5006 | Lid |
| 5010 | Storage compartment |
| 5014 | Botton surface |
| 5015 | Wrist rest |
| 5016 | Protrusion |
| 5017 | Base |
| 5018 | Keyboard |
| 5020 | Ridge |
| 5024 | Grip |
| 5028 | Hinge |
| 5032 | Leg |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 4:
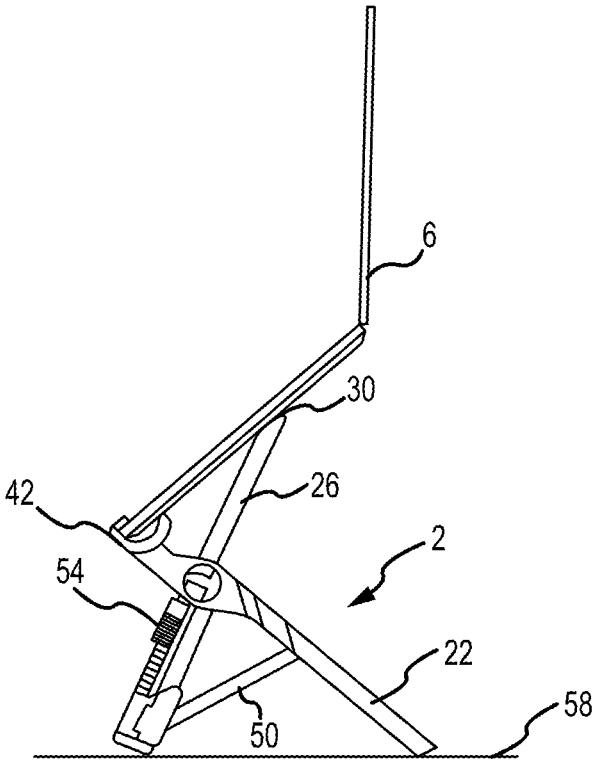
FIG. 4 is a right elevation view of the stand of FIG. 3 positioned at the first height.
Figure 5:
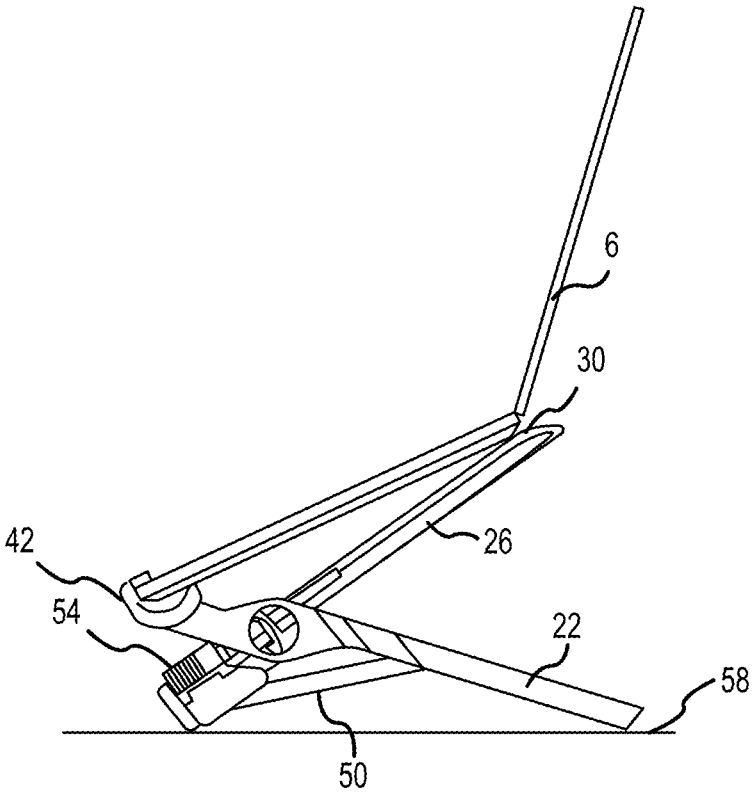
FIG. 5 is a right elevation view of the stand of FIG. 3 positioned at a second height.

FIGS. 1-5 show a stand 2 of one embodiment of the present invention configured to support a laptop computer 6. The stand 2 generally consists of opposing side frame structures 14 interconnected by a cross frame structure 18 consists of cross frame members 20. The side frame structures comprise a leg 22 and arm 26. The arm 26 includes a first end with an engagement surface 30 configured to receive the screen of the laptop computer 6 and a second end that forms at least a portion of a base segment 34 configured to rest on a flat surface. The leg 22, which is slidingly and rotatably associated with the arm 26, includes an upper end that accommodates a gripping mechanism 42 and a second end that acts as a foot configured to engage the flat surface. The gripping mechanism 42 is adapted to engage and secure a front edge 48 of the laptop computer 6. The leg 22 is further interconnected to the base segment 34 of the arm 26 by a cross link 50 to add stability to the expanded stand. In addition, some embodiments of the present invention are equipped with height adjusting functionality. Here, a height adjustment and maintaining mechanism 54 (hereinafter "height adjustment mechanism") is operatively interconnected to the arms 26, which will be described in further detail below. As shown in FIGS. 4 and 5, movement of the height adjustment mechanism 54 along the length of the arms 26 will alter the vertical distance between the gripping mechanism 42 and the flat surface 58 supporting the stand 2, thereby altering the height of the laptop computer.

Figure 6:
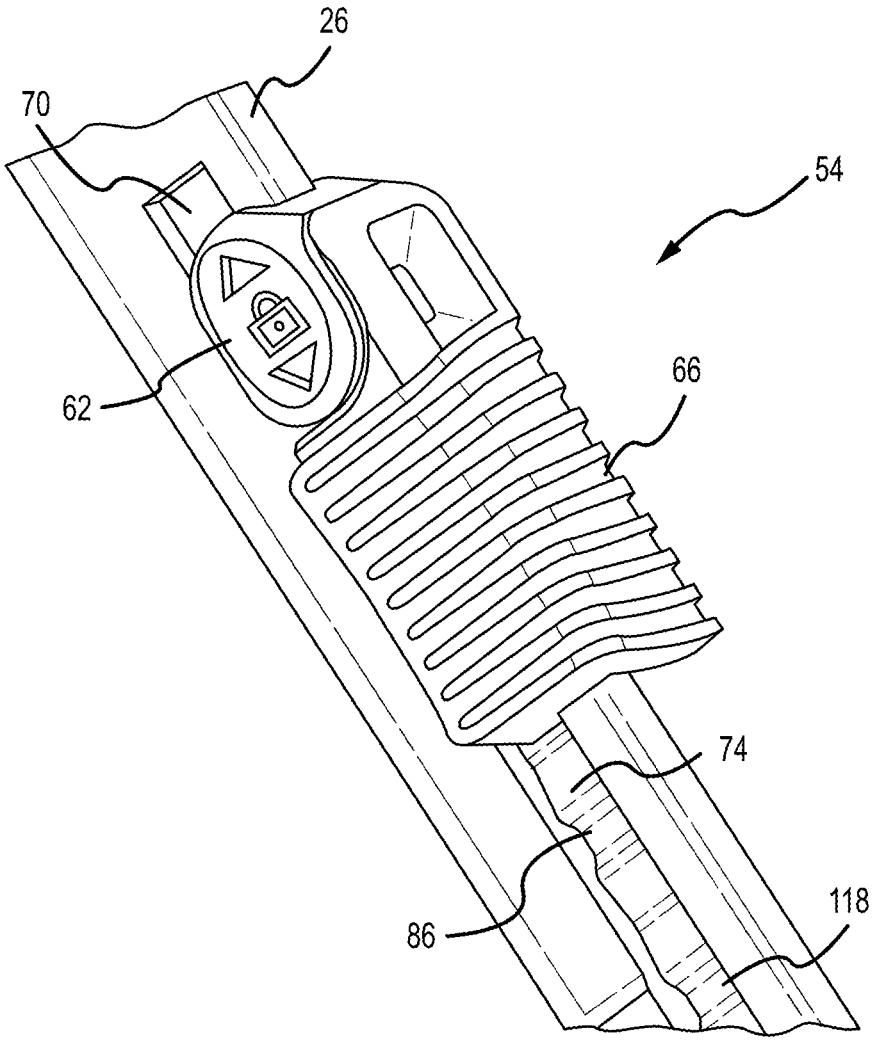
FIG. 6 is a detailed view showing a height adjusting and maintaining mechanism of one embodiment of the present invention.
Figure 7A:
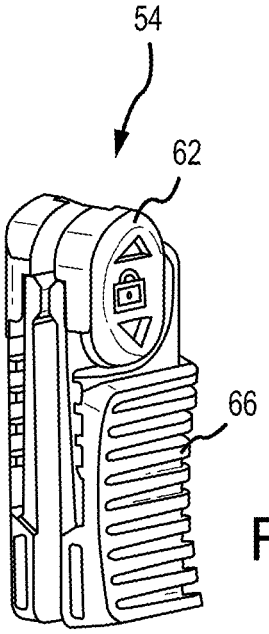
FIG. 7A is a front perspective view of the height adjusting and maintaining mechanism shown in FIG. 6 in a locked configuration of use.
Figure 7B:
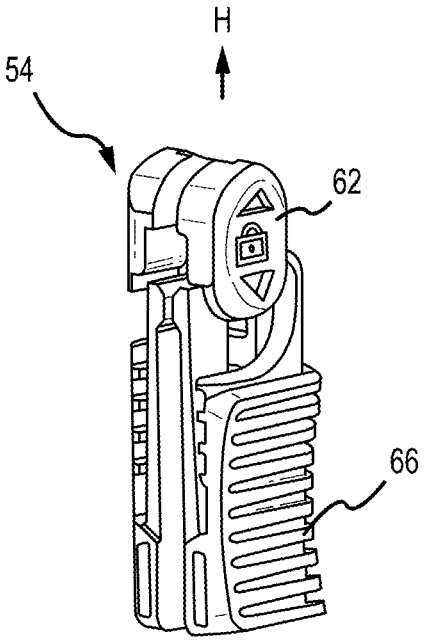
FIG. 7B is a front perspective view of the height adjusting and maintaining mechanism shown in FIG. 6 in an unlocked configuration of use.
Figure 7C:
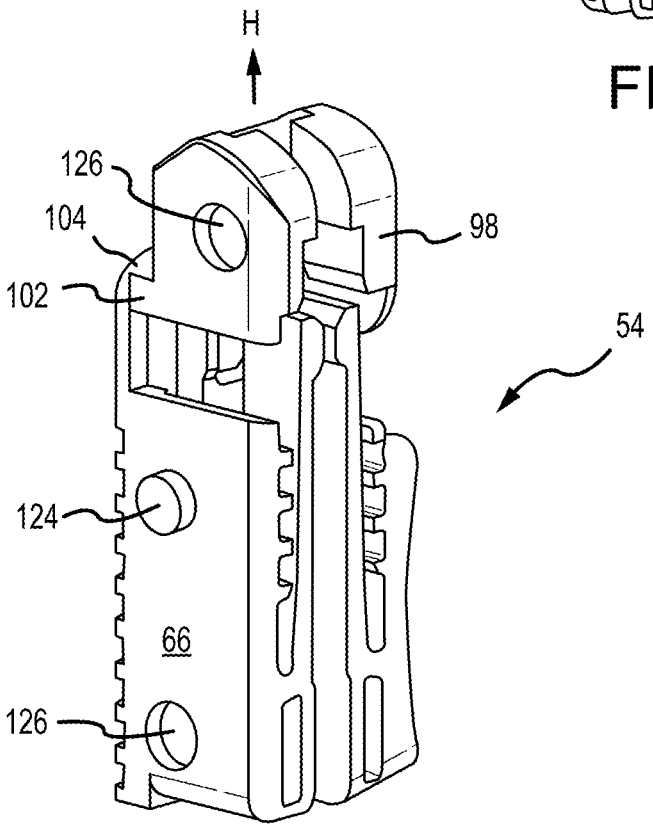
FIG. 7C is a rear perspective view of the height adjusting and maintaining mechanism shown in FIG. 6 in an unlocked configuration of use.
Figure 8:
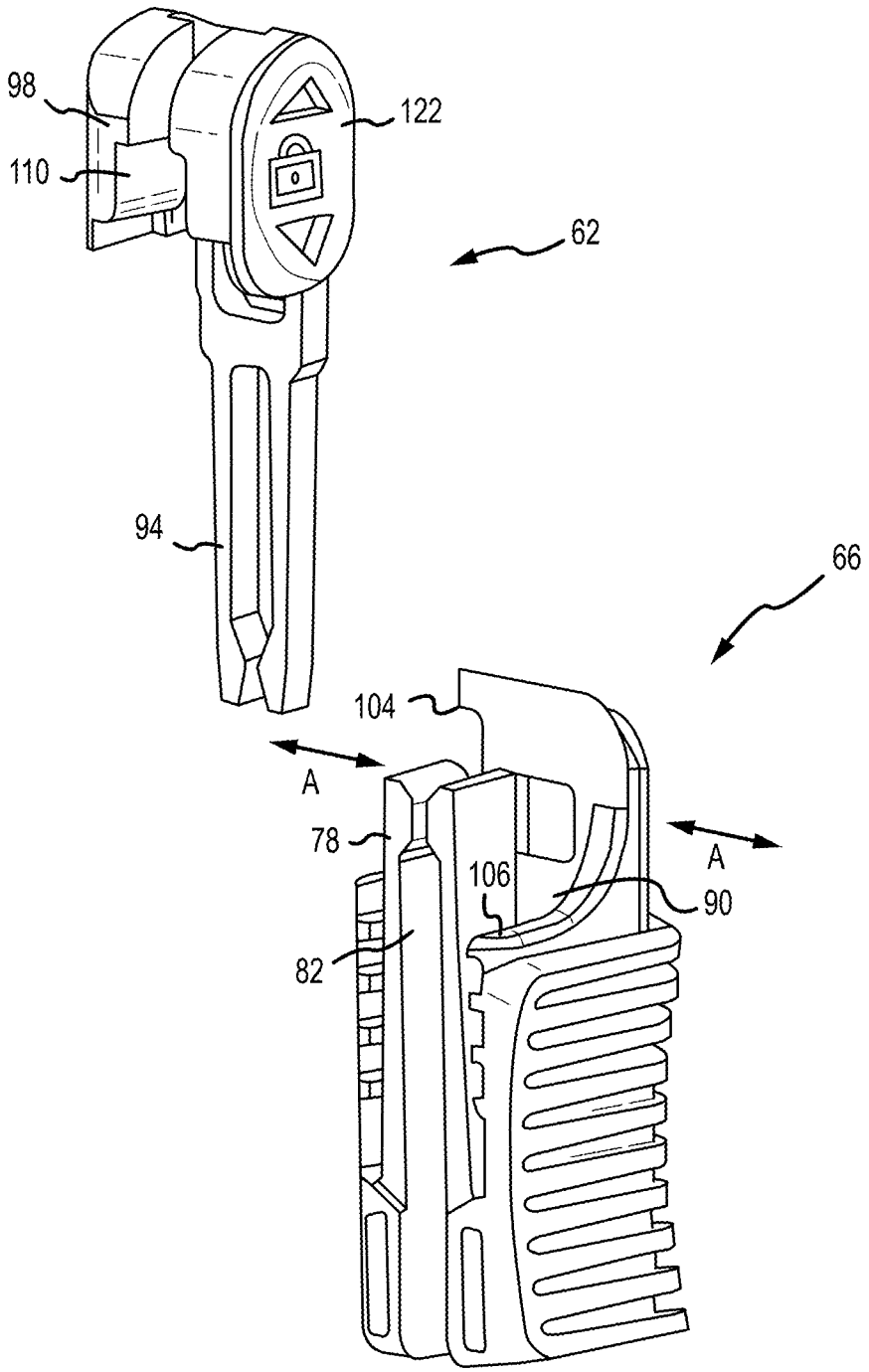
FIG. 8 is an exploded view of FIG. 7A.

FIGS. 6-8 show the height adjustment mechanism 54 of one embodiment of the present invention comprising a lock 62 operatively interconnected to a carrier 66. The height adjustment mechanism 54 is associated with at least one channel 70 integrated into the arms 26 of each side frame structure. The channel includes a plurality of teeth 74 that selectively interface with locking protrusions 78 provided on the carrier 66. The locking protrusions 78 are interconnected to the flexible lock arms 82 cantilevered to a base portion of the carrier 66. In operation, the lock arms 82 move outwardly and inwardly along Arrow A as the carrier 66 is moved along the arms 26 and the locking protrusions encounter lateral side surfaces 86 of the teeth. The lateral side surfaces 86 may be angled or arcuate to facilitate carrier movement. The carrier 66 also includes a longitudinal cavity 90 that receives fingers extending from a body portion 98 of the lock 62. The fingers 94 help guide the lock 62 into the carrier 66 and control the motion of the lock 62 relative to the carrier 66 as the lock is engaged and disengaged. As shown in FIG. 7C bodies 98 also include protrusions 102 that selectively engage stops 104 provided on an upper end of the carrier 66 to prevent extension of the lock beyond a predetermined distance.

Figure 19:
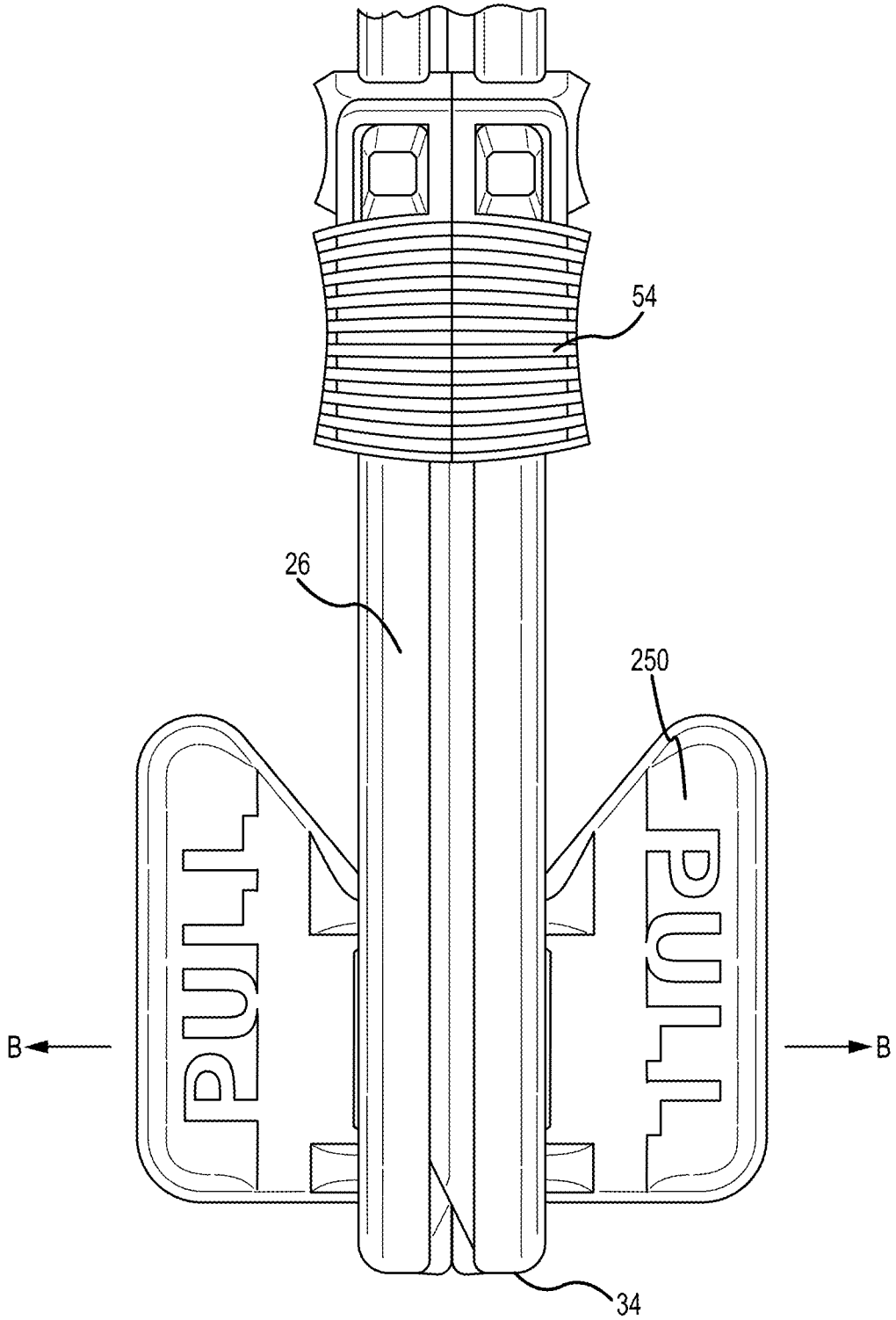
FIG. 19 is a detailed view of FIG. 15, wherein pull tabs are extended outwardly.

In operation, when the lock 62 is disengaged from the carrier, i.e., when the body portion 98 is separated from the upper surface 106 of the carrier 66, the height adjustment mechanism 54 can slide along the arms 26. After a preferred laptop computer height is selected, the body portion 98 is brought into proximity with the upper surface 106 of the carrier 66 by using the thumb/finger pads 122, which engages an inward-facing surface 110 of the lock's body portion 98 onto an outwardly-facing surface 114 associated with the locking protrusions. When the height adjustment mechanism 54 is in the locked position as shown in FIG. 7, this engagement prevents the locking protrusions 78 from moving outwardly along Arrow A, which maintains the locking protrusions 78 within a locking space 18 located between adjacent teeth 74. Alternatively, the locking protrusions can be adapted to grip a leg Movement of the body portion from a locked to unlocked position along Arrow H may be facilitated by thumb/finger pads 122. The carriers 66 of corresponding arms may selectively interconnected to facilitate adjustment when the stand is in the collapsed configuration as shown in FIG. 19. For example, the carrier 66 and/or body portion 98 may include detents 124 that are selectively received in corresponding cavities 125 of adjacent height adjustment mechanism (see, FIGS. 8B and 9) to temporarily interconnect height adjustment mechanisms for coordinated movement. One of ordinary skill in the art will appreciate that other mechanisms may be used to selectively lock the height adjustment mechanisms relative to the arms, one of which is described herein.

Figure 9:
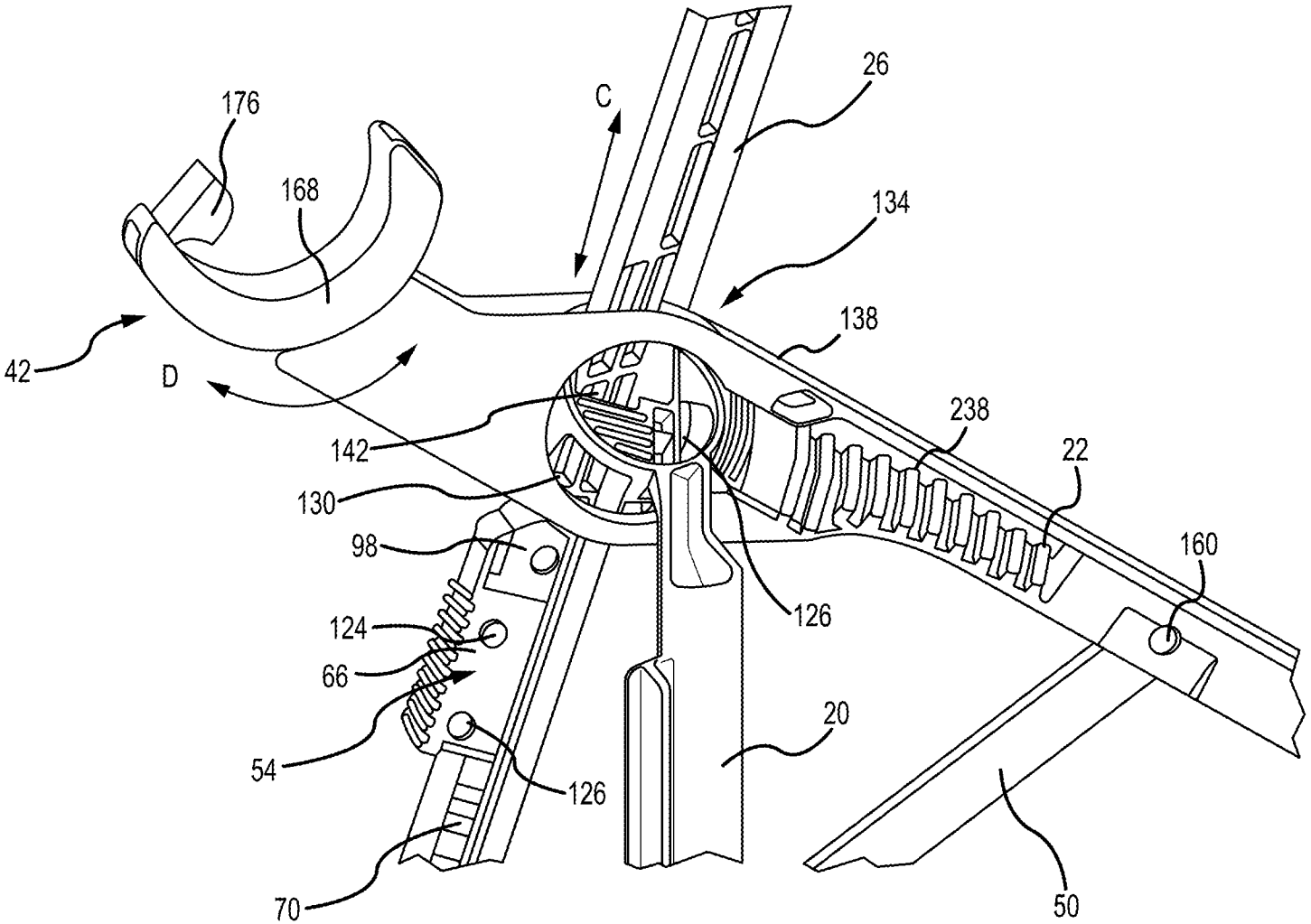
FIG. 9 is a detailed side perspective view illustrating the upper interconnection between an arm, a leg, cross frame member, and a cross link member of one embodiment of the present invention.
Figure 10:
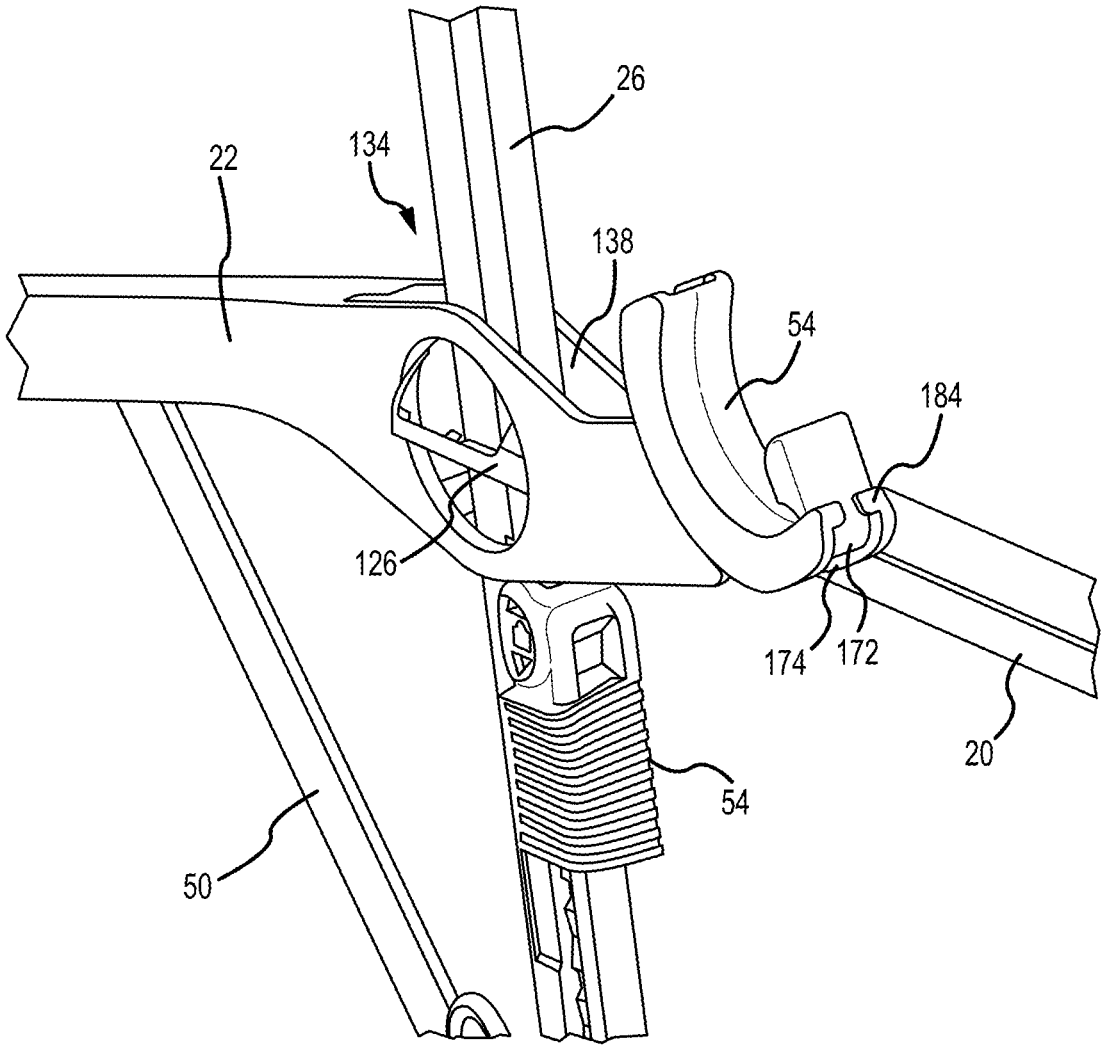
FIG. 10 is a detailed front perspective view showing the interconnected components shown in FIG. 9.

FIGS. 9 and 10 illustrate how portions of the stand of one embodiment of the present invention are interconnected. Here, the cross frame member 20 includes a head 126 on its upper portion. The head 126 has a spherical outer profile that fits within a corresponding socket 130 integrated into each leg 22. Each leg 22 also defines a slider mechanism 134, which generally consists of a longitudinal opening 138 and a corresponding opening 142 in the head 126 that operatively receive the arm 26. In operation, when the base segments of the arms 26 are moved away from each other in the direction of Arrow B (see, FIG. 19), the slider mechanism 134 will urge the gripping mechanisms 42 away from each other. This motion will also move the slider mechanisms 134 downwardly along Arrow C towards the base segments. Eventually, a lower surface of the legs will abut the locks, thereby arresting the motion thereof and setting a laptop computer height. If a lock(s) is in the open position when the stand is expanded, the force exerted on upper portions of the body 98 by the lower surface of a leg will force the lock 62 into the carrier 66, thereby setting the location of the height adjustment mechanism 54 and preventing accidental movement of the leg lower than intended.

When the base segments are moved in the direction opposite to Arrow B, the side frame structures move closer to each other and the gripping mechanisms are rotated towards the engagement surfaces of the arms. The expanding/collapsing operation also causes the lower ends of the cross frame members to rotate about a pivot point associated with the base segment of the arms, which selectively changes the angle of the head relative to the outside surface of the leg. In one embodiment of the present invention, which will be described in further detail below, when fully collapsed, a portion of the head is substantially flush with the outer surface of the leg. Movement of the side frame structures will also cause the cross-link members 50 to rotate relative to a pivot point 160. A lower end of the cross link member 50 is also attached to a pivot point associated with the base segment, wherein movement of the side frame member to collapse the stand will conceal the cross link members 50 inside longitudinal grooves 164 provided in the legs 22 (see, FIG. 14).

The gripping mechanism 42 is very similar to that described in U.S. Pat. No. 9,894,988 mentioned above and includes a rotating member 168 that rides in an arcuate track (not shown). An elastic band 172 resides in a channel 174 and is operatively interconnected to the rotating member 168 that ends in a nub 176 that selectively engages the laptop's front edge. The rotating member 168 is, thus, configured to move along Arrow D to accommodate differing stand heights, computer sizes, etc. In one embodiment of the present invention, the band 172 is maintained within the channel 174 by at least one finger 184.

Figure 11:
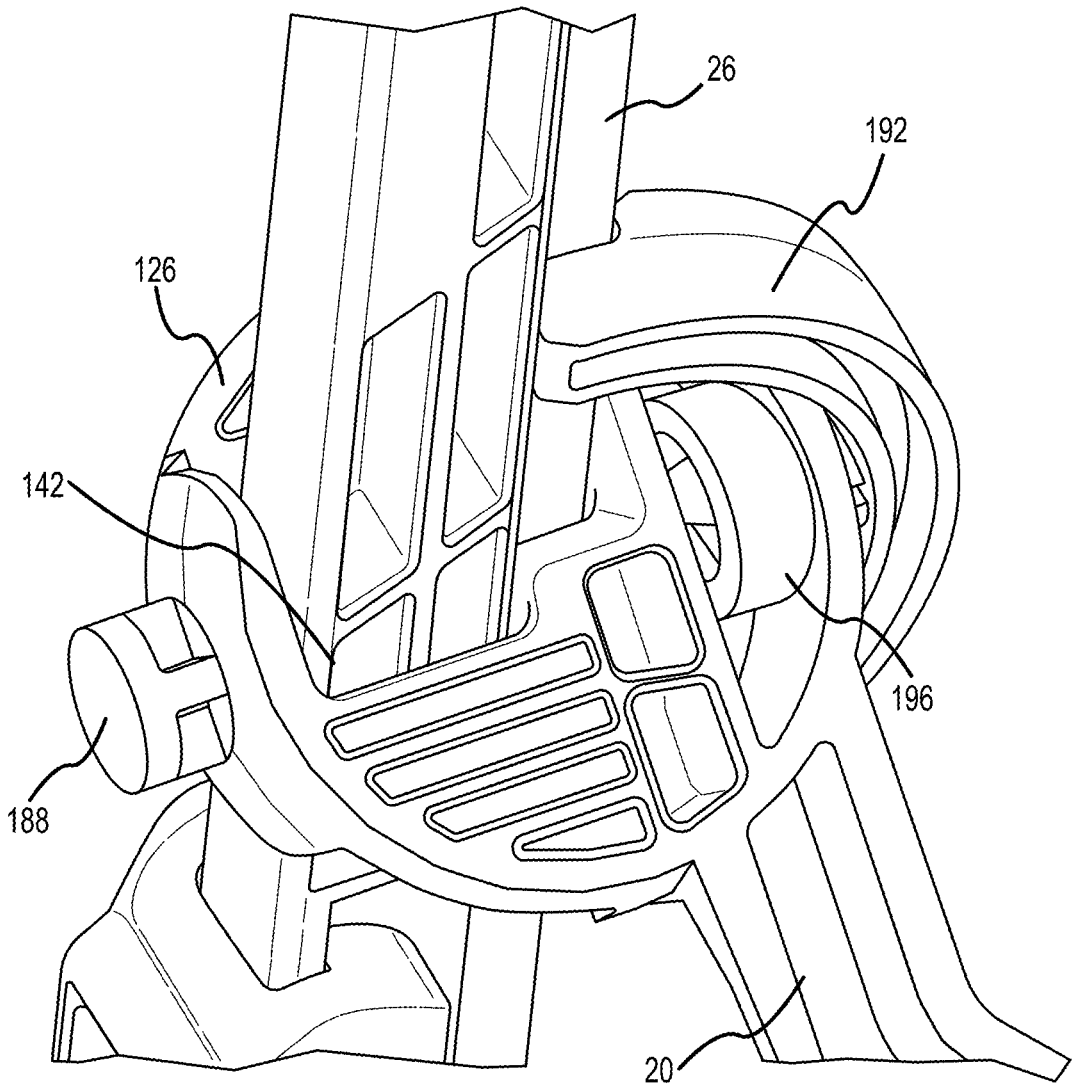
FIG. 11 is a detailed view illustrating the operative interconnection between the arm and a head of the cross member of one embodiment of the present invention.
Figure 12:
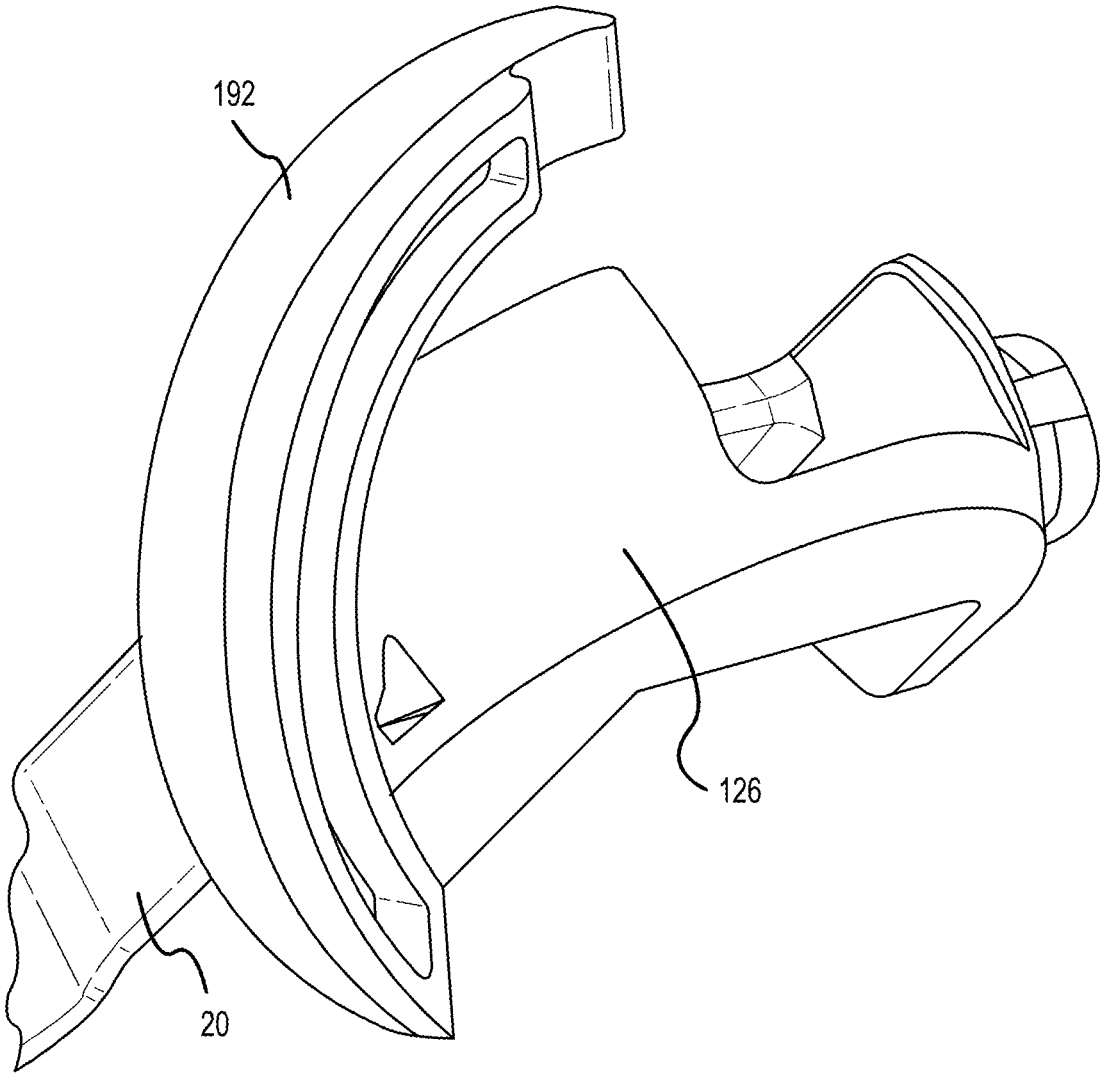
FIG. 12 is a detailed view focusing on the head of the cross frame member of one embodiment of the present invention.

FIGS. 11 and 12 show the interaction between the arms 26 and the head 126, wherein the leg has been removed for clarity. The head of one embodiment has a spherical outer surface with a pin 188 extending therefrom configured to maintain the head's interconnection with the leg as it slides and rotates relative to the arm as the stand is expanded and collapsed. A retainer 192 is positioned opposite the pin 188 and is configured to interface with the inner surface of the socket to operatively secure the head 126. The retainer may include a boss 196 that receives a corresponding pin (not shown) inwardly extending from the retainer 192. The retainer 192 rotates within the socket when the stand is extended and collapsed, allowing the slider mechanism to move freely along the arm. The retainer also allows for the head to be interconnected to the socket during manufacturing. Alternatively, the retainer can be omitted, and the head may be snap-fit into the socket.

Figure 13:
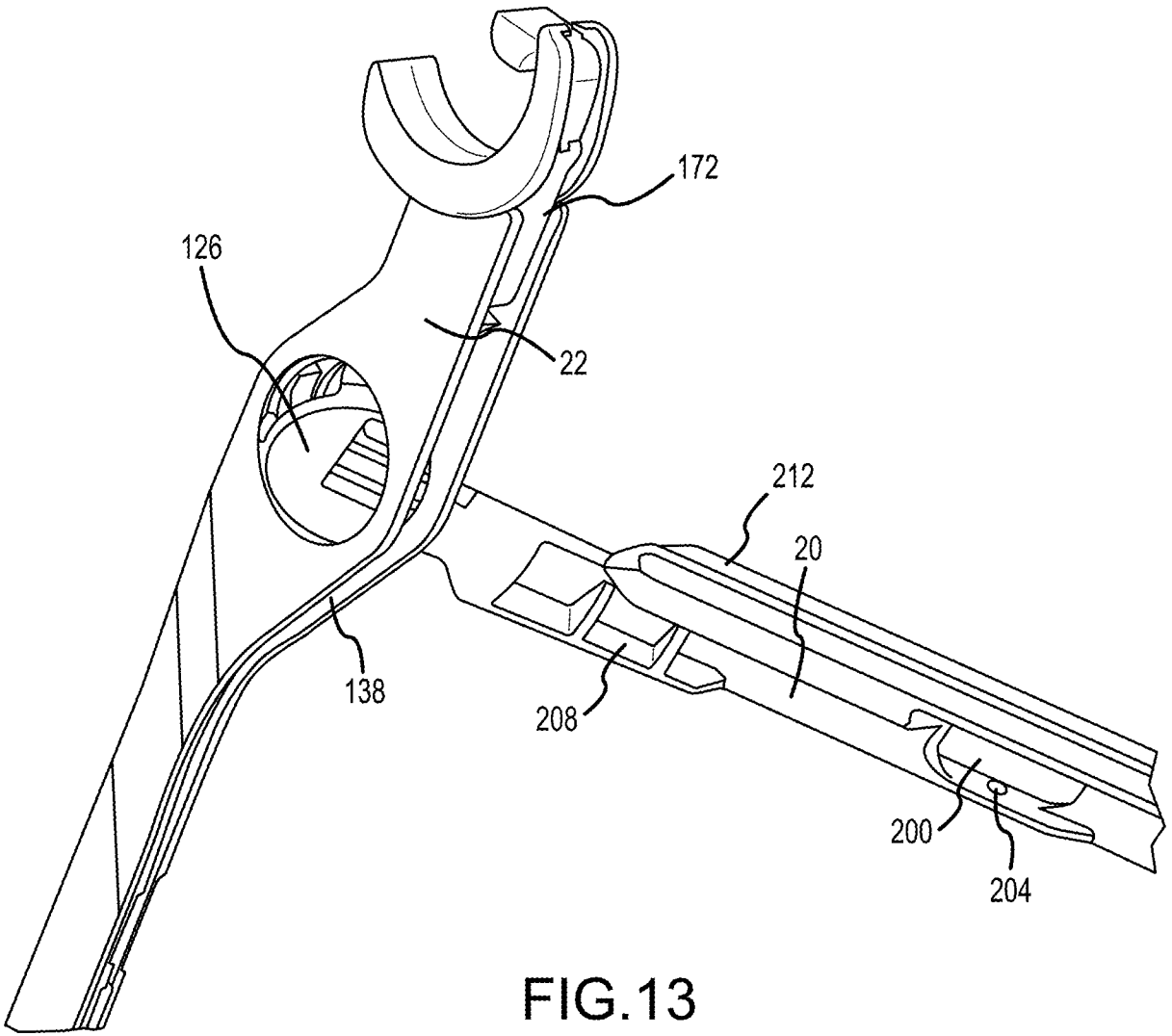
FIG. 13 is a perspective view showing features of the cross frame member of one embodiment of the present invention.

FIG. 13 highlights the cross frame member 20 of one embodiment of the present invention and its interactions with the leg operatively interconnected thereto. The cross frame member includes an opening 200 that receives the corresponding cross frame member, which is held in place by a pin 204 that interconnects the cross frame members that allows them to rotate relative to each other when the stand is collapsed and expanded. The cross frame members may also include stiffening ribs 208 that allows the cross frame member 20 to be made of thinner material if desired. Stiffening of the cross frame member is also achieved by perpendicularly disposed stiffening ribs 212 that substantially extend the entire length of the cross frame members. Because one cross frame member penetrates the other, the perpendicularly disposed stiffening rib 212 of one cross frame member will be located behind the perpendicularly disposed stiffening rib 212 of the other cross frame member. Accordingly, when collapsed, the rib 212 of the penetrating cross frame member will be nested behind the rib 212 of the forward-most cross frame member.

Figure 14:
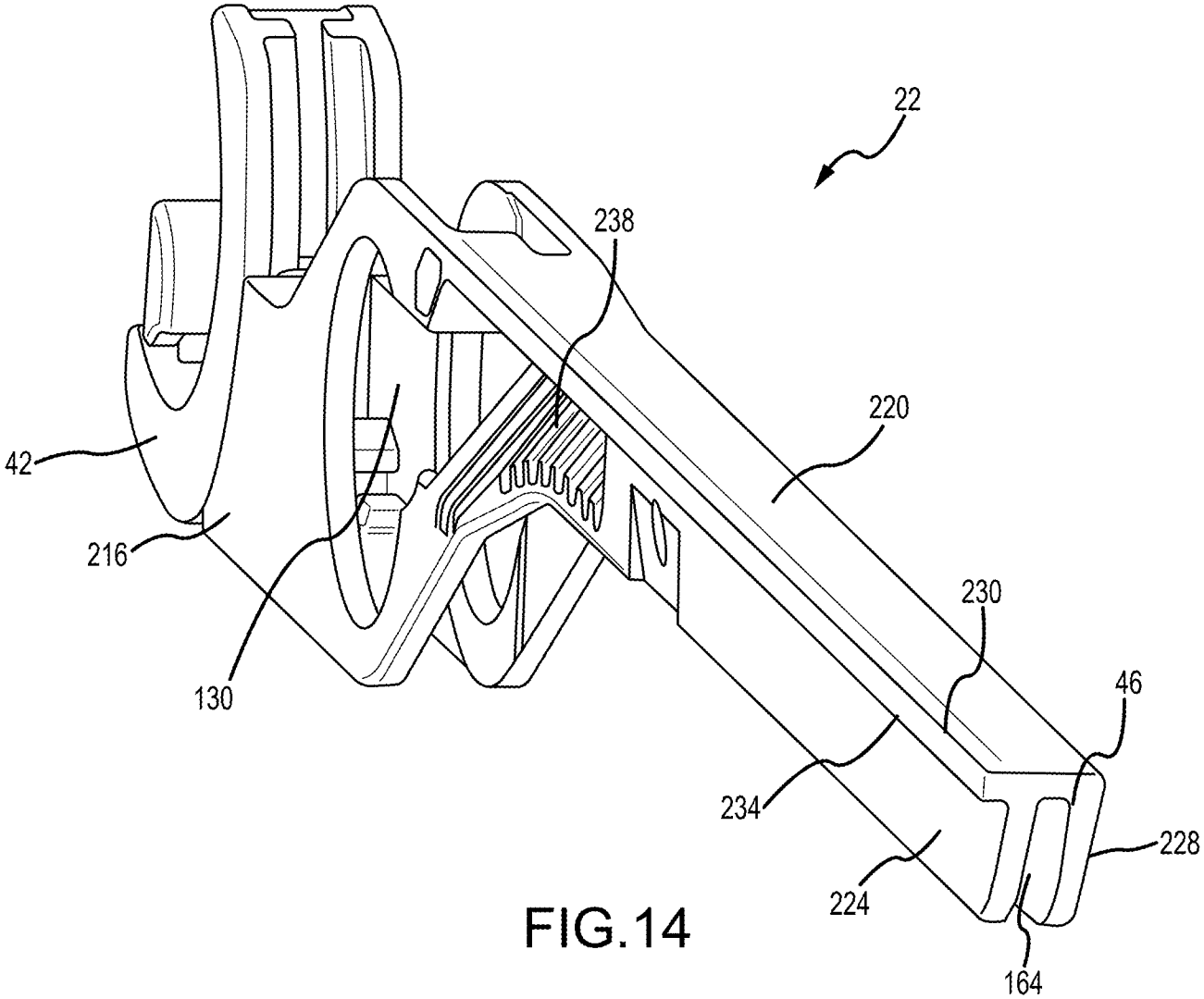
FIG. 14 is a perspective view of the leg employed by some embodiments of the present invention.
Figure 15:
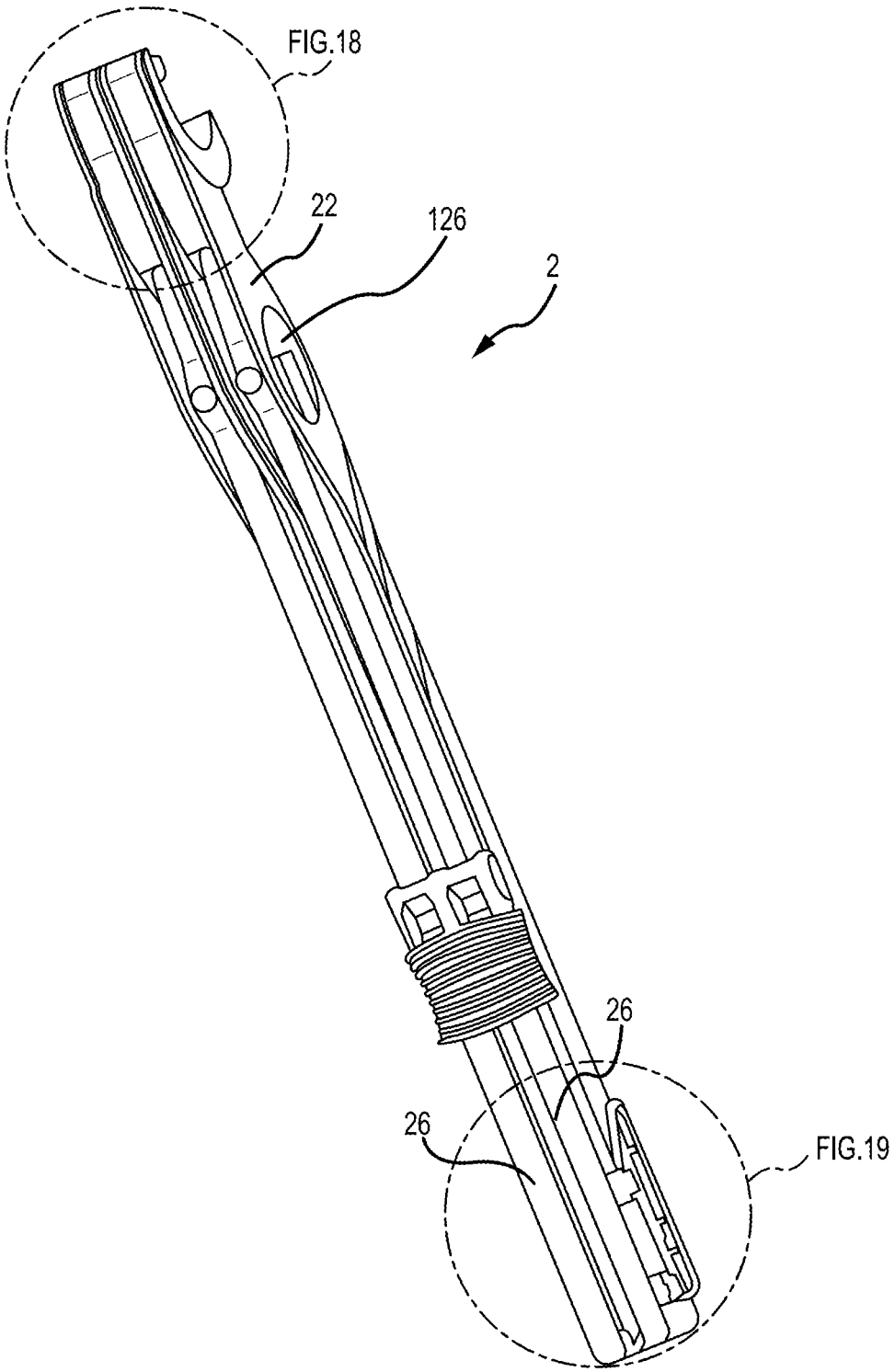
FIG. 15 is a front perspective view showing the stand of FIG. 3 in a collapsed position of use.
Figure 16:
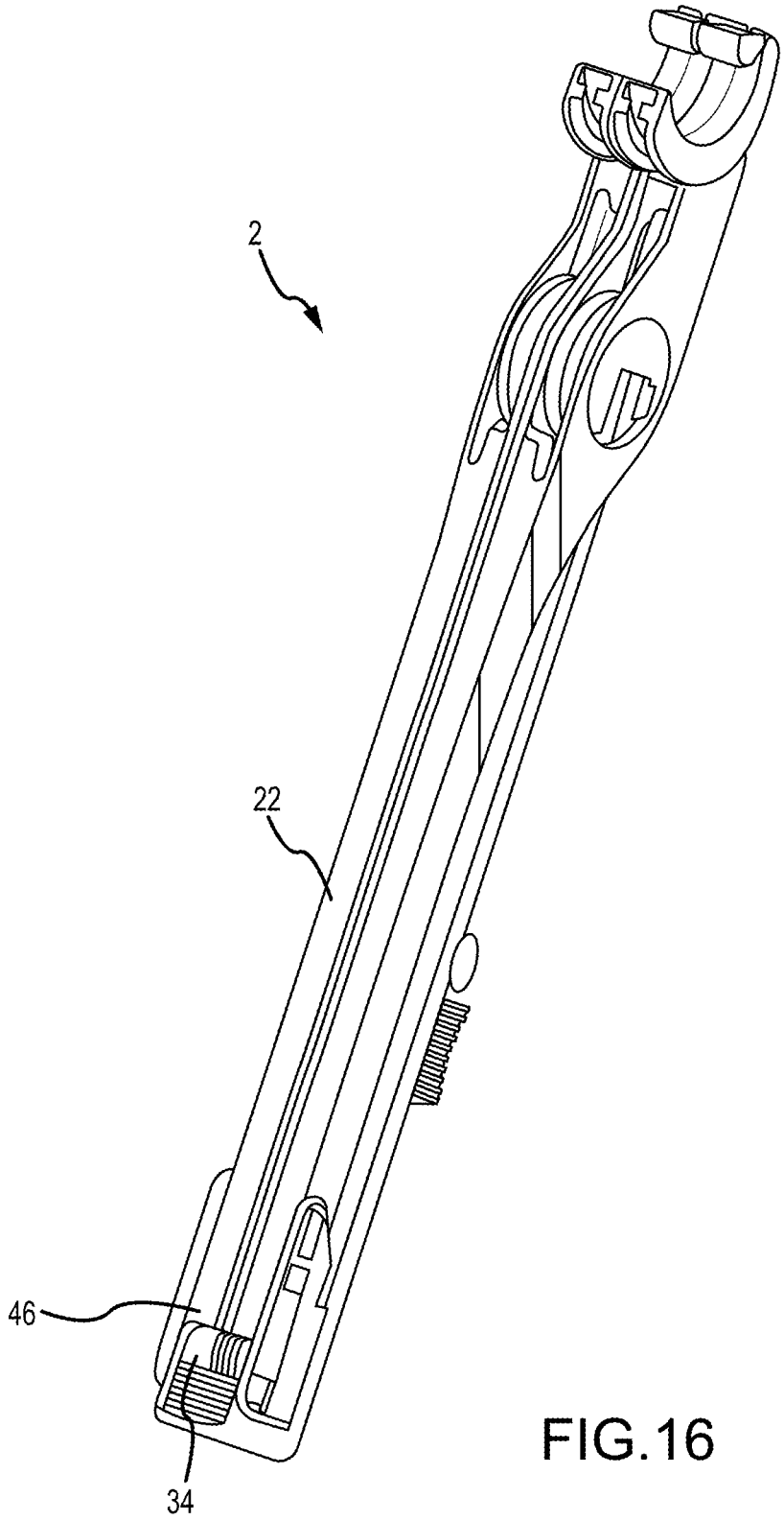
FIG. 16 is a rear perspective view showing the stand of FIG. 3 in the collapsed position of use.
Figure 17:
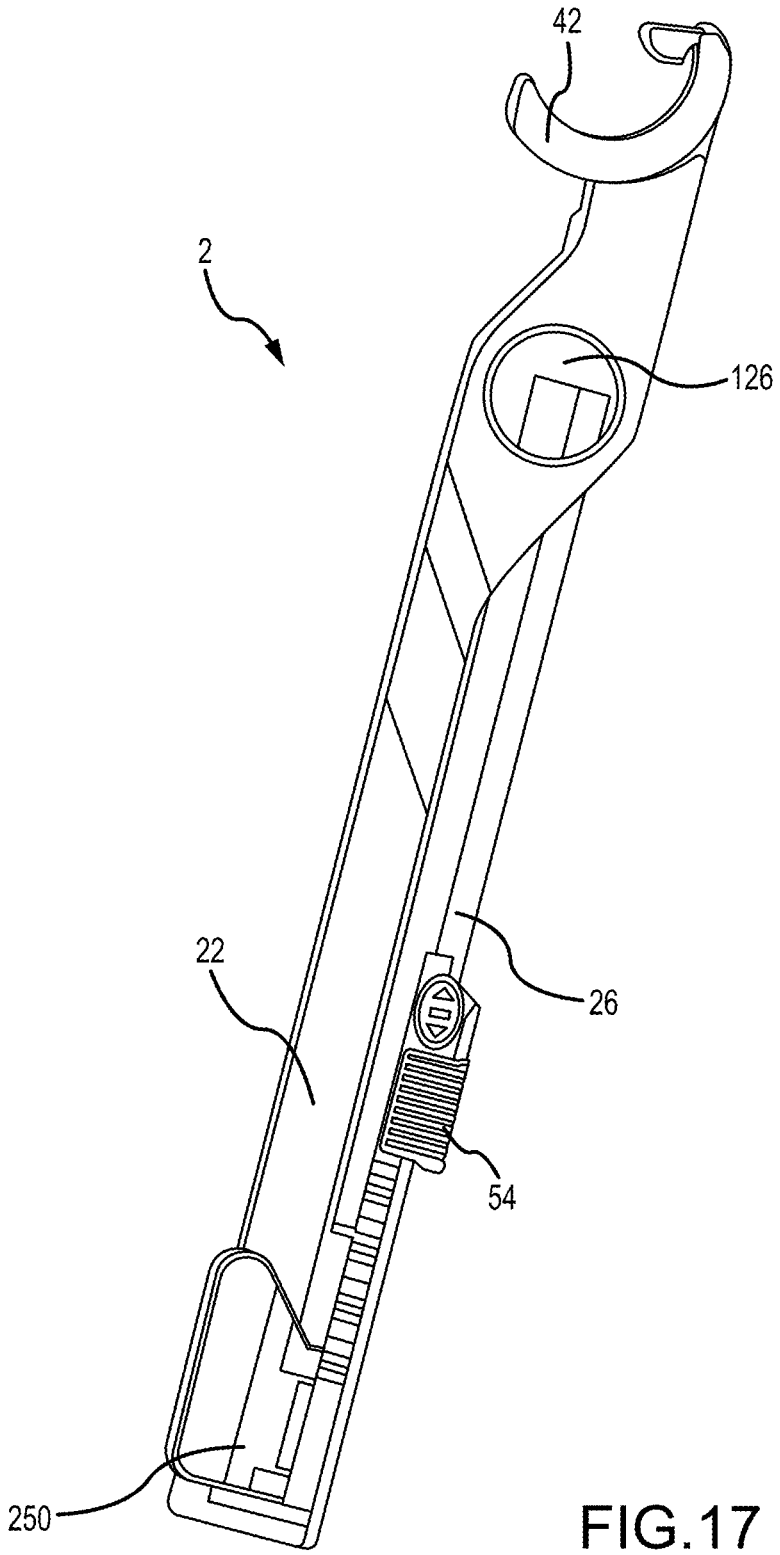
FIG. 17 is a side elevation view showing the stand of FIG. 3 in the collapsed position of use.
Figure 18:
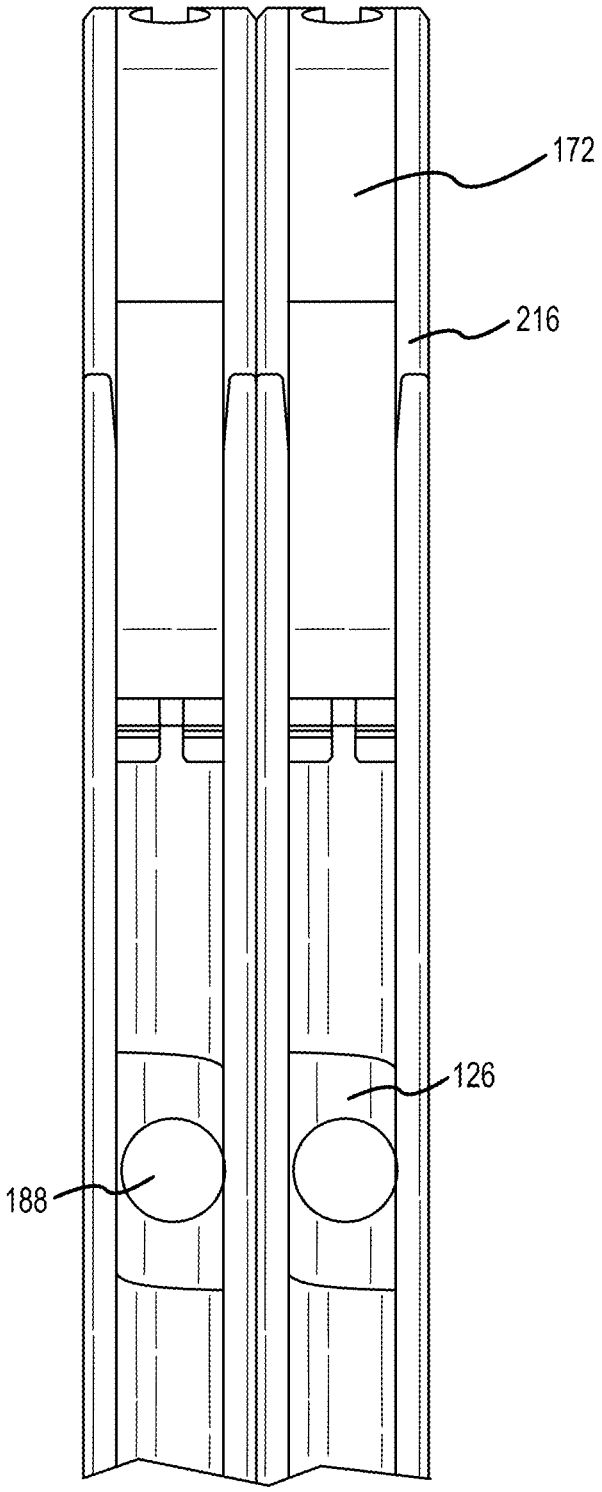
FIG. 18 is a detailed view of FIG. 15.

FIG. 14 shows a leg 22 of one embodiment of the present invention with an upper end 216 associated with the gripping mechanism 42 and a lower end associated with the foot 46. The leg 22 includes an outer surface 220 with sidewalls 224, 228 extending therefrom to define a longitudinal groove 164. The outer surface 220 may extend from the arm inner sidewall 224 to define a ledge 230. As will be appreciated upon review of FIG. 16, inner surfaces 234 of opposing legs 22 engage when the stand is in the collapsed position. The leg 22 may also include a cavity 238 configured to receive the rib 208 of the cross frame member 20 as the stand is transitioned into the collapsed position.

FIGS. 15-19 show the stand 2 and the collapsed configuration, wherein inner surfaces of the gripping mechanisms 42 are placed in close proximity. Also, as discussed above, portions of the legs contact to conceal the folded cross frame structure. Here, the feet of the side frame structures, which are located above the base segments 34, contact each other. The base segments may include a knurled surface to facilitate grasping by the user's thumbs and index fingers, which gives the user tactile confirmation of the correct grasping locations, which may prevent obstruction of the feet that would otherwise prevent outward motion of the base segments. Some embodiments of the present invention include pull tabs 250 attached to the base segments that may be biased against the outside surface of the arms, which will be described in further detail below. The pull tabs, which may be removable, facilitate expanding the stand and reduces the chances that the user will adversely affect the motion of the legs as they are deployed.

Figure 20:
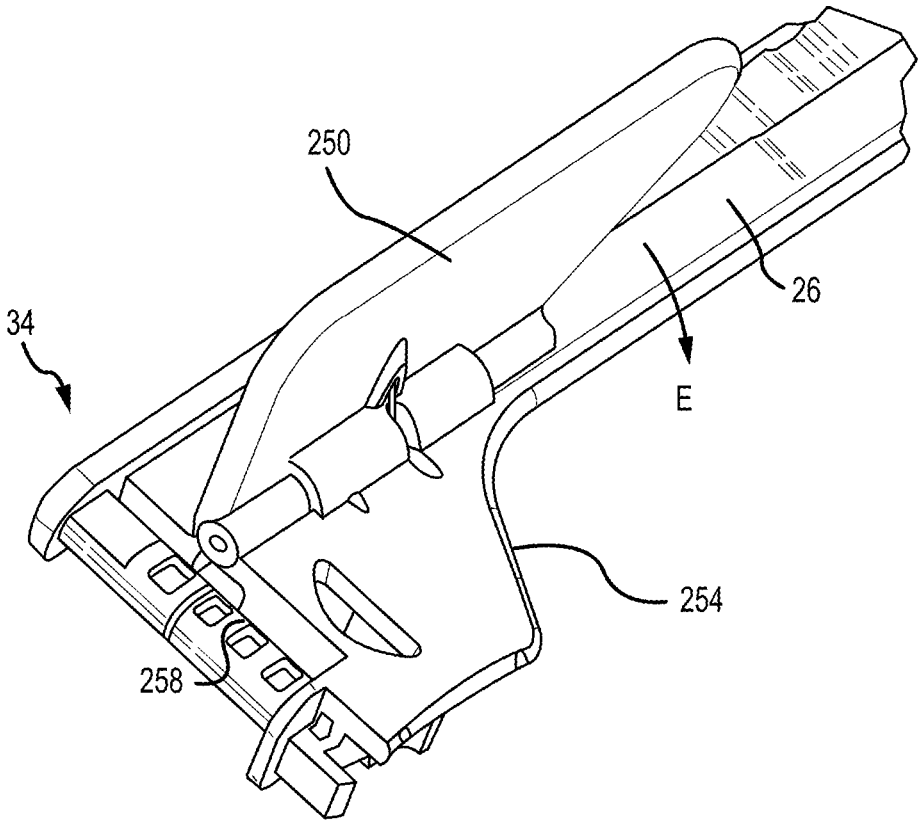
FIG. 20 is a detailed view of a base segment of the stand of one embodiment of the present invention showing a pull tab extended outwardly.
Figure 21:
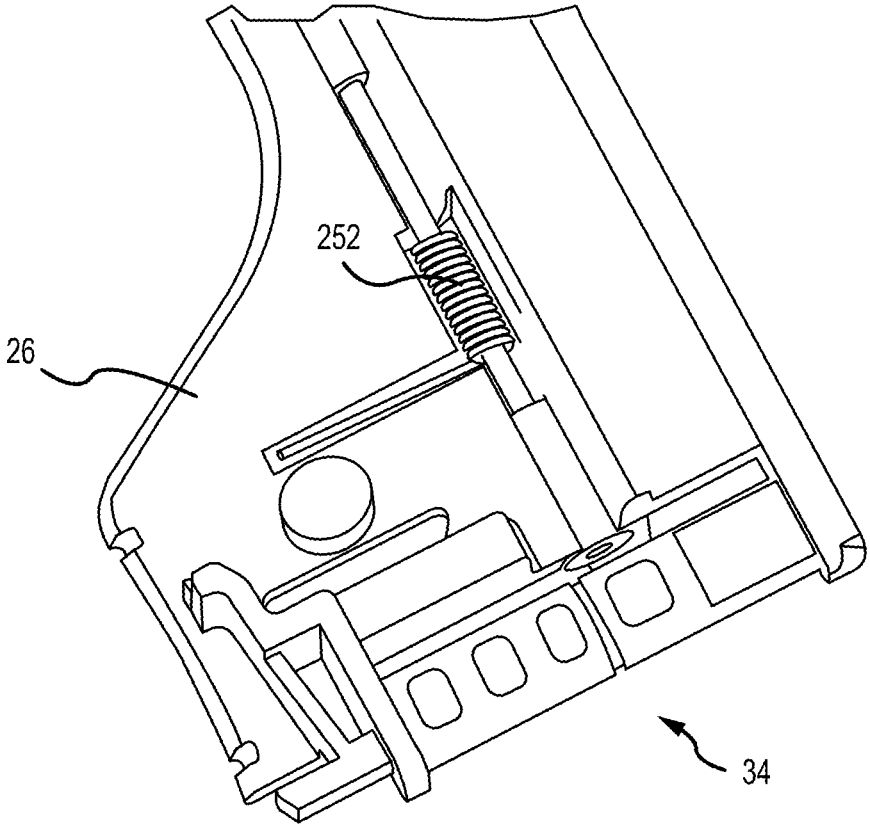
FIG. 21 is a detailed view oriented opposite that of FIG. 20, showing a biasing member that normally maintains the pull tab against the arm.

FIGS. 19 and 20 show the pull tabs 150 of one embodiment of the present invention operatively associated with the arms 26 of some embodiments of the present invention. The pull tabs 150 can employ a traditional hinge mechanism as shown or comprise a living hinge. The pull tabs 150 are biased with the spring 252, for example, in the direction of Arrow E, and lay flat against an outer surface 254 of the arm's base segments. In operation, the user counteracts the spring force by rotating the pull tabs 150 in the direction opposite Arrow E and pulls the base segments 34 away from each other in the direction of Arrow B. Once the stand is expanded, the user removes pressure from the pull tabs, which return to rest against the outer surface 254. This functionality virtually eliminates accidental user engagement with the feet, which allows for a smooth transition from the collapsed position to the expanded position. FIG. 19 also shows the height adjustment mechanisms 54 interconnected as a unit as mentioned above, which allows for the height of each side frame structure to be modified in the same fashion by moving both locks to the unlocked position. Finally, FIG. 20 shows a hub 58 that rotatably receives lower ends of the cross frame members.

Figure 22:
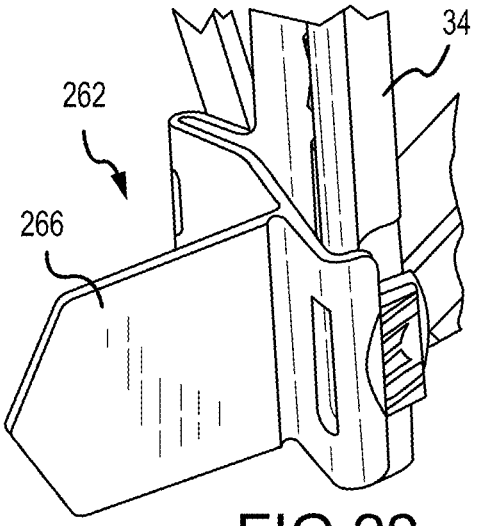
FIG. 22 is a perspective view showing a removable tab interconnected to a base segment of one embodiment of the present invention.
Figure 23:
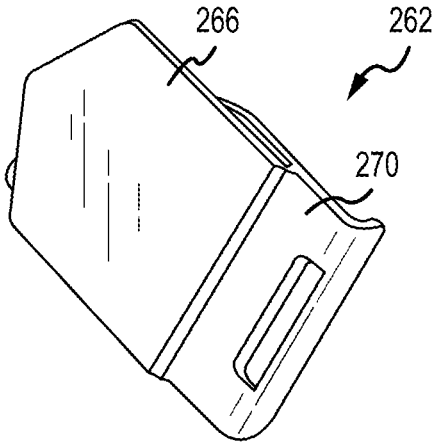
FIG. 23 is a front elevation view of the removable tab.
Figure 24:
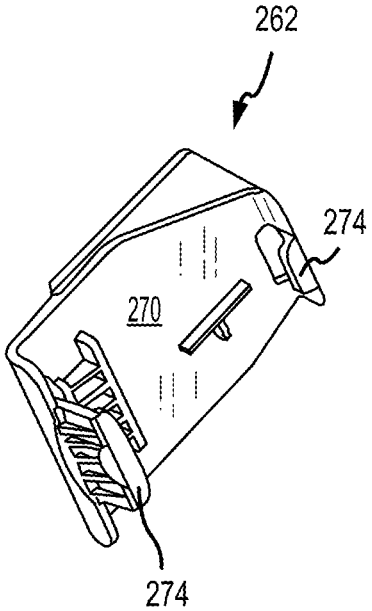
FIG. 24 is a rear elevation view of the removable tab.

One of ordinary skill in the art will appreciate that the pull tabs can be removable such that they are selectively interconnected to the end segments of each leg. More specifically, FIGS. 22-24 show a removable pull tab 262 comprising a tab portion 266 operatively interconnected to a gripping member 270. Here, a living hinge is provided that interconnects the tab portion 266 to the gripping member 270, but other mechanisms for rotatable interconnection are contemplated. In other embodiments, the orientation of the tab portion is fixed relative to the gripping member. In this embodiment, the gripping member 270 is interconnected to the base segment 34 by selectively to flexible fingers 274.

Figure 25:
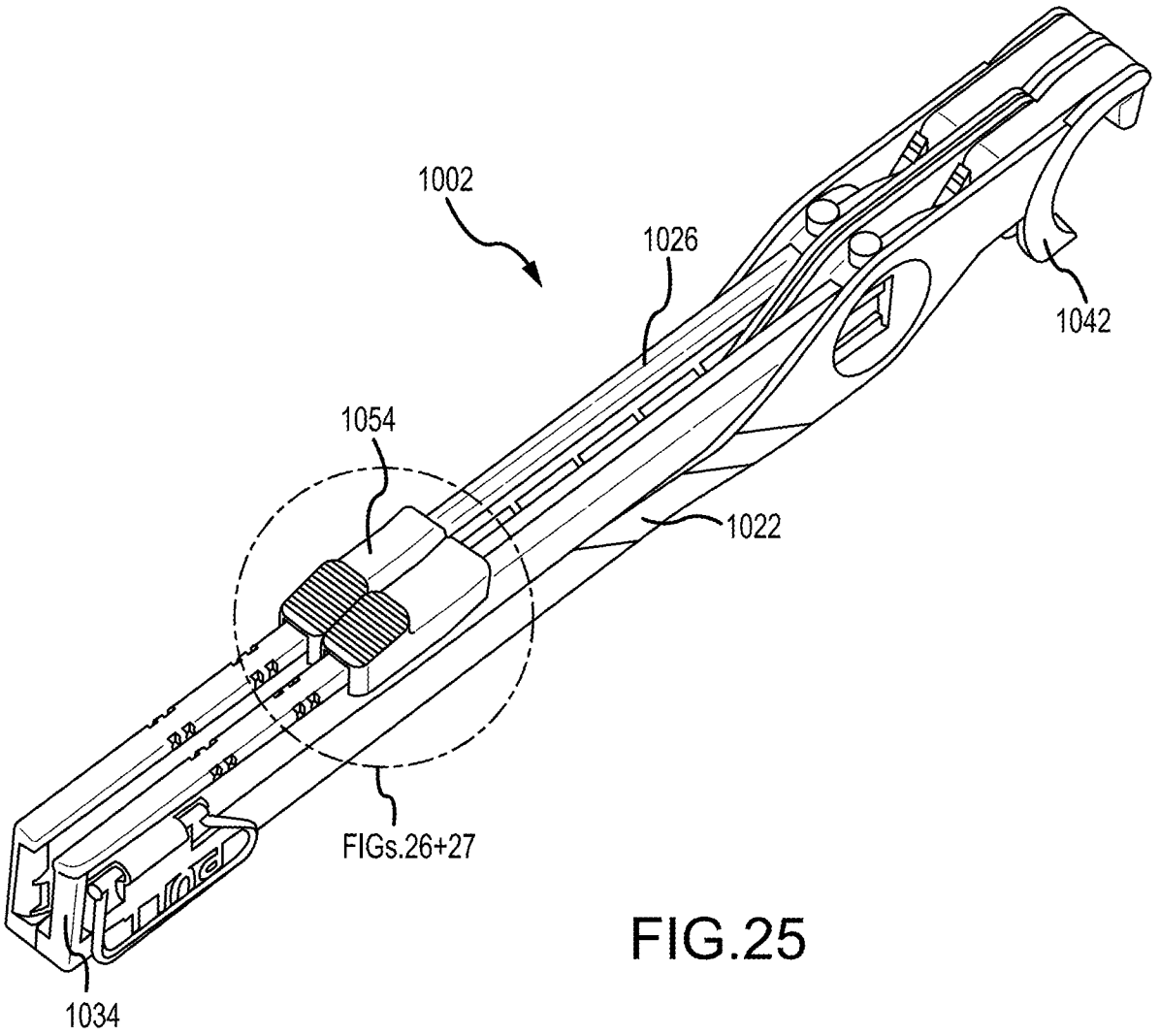
FIG. 25 is a perspective view of another embodiment of the present invention that employs an alternate height adjustment and maintaining mechanism.
Figure 26:
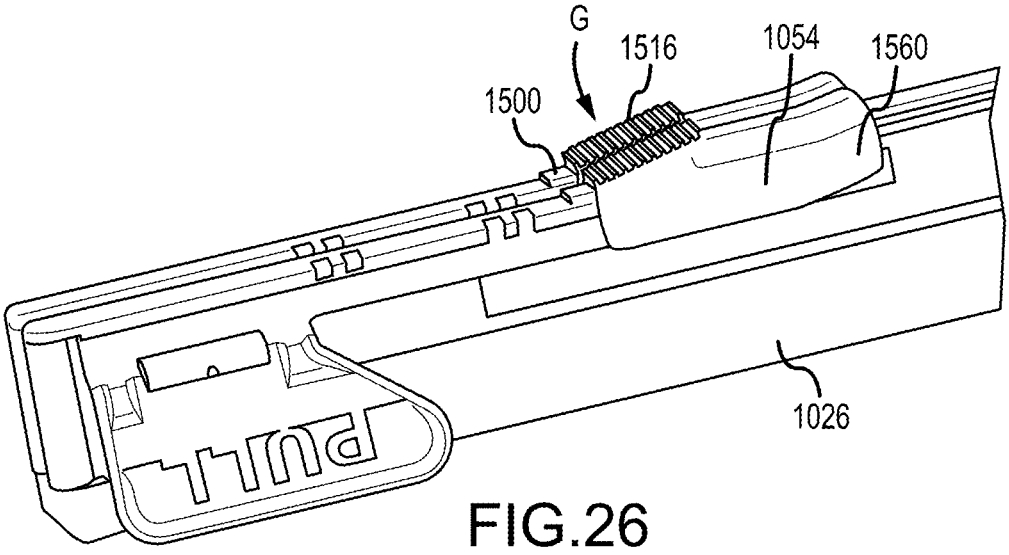
FIG. 26 is the height adjustment and maintaining mechanism of FIG. 25 in an open configuration.
Figure 27:
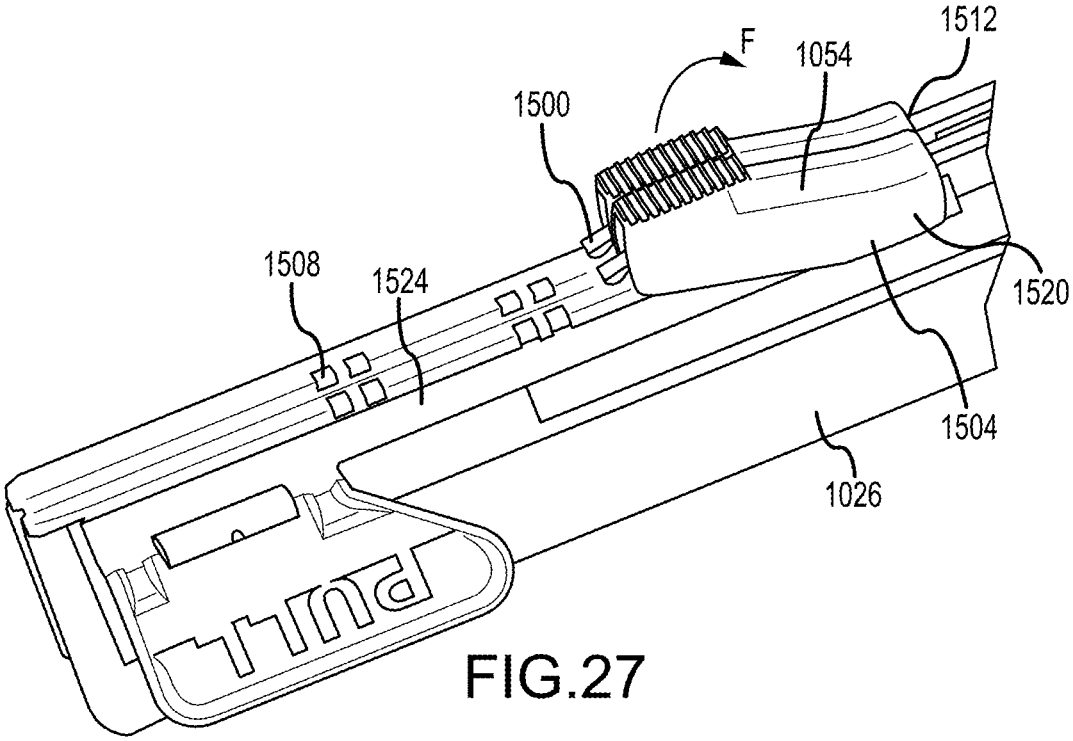
FIG. 27 is the height adjustment and maintaining mechanism of FIG. 25 in a closed configuration.
Figure 28:
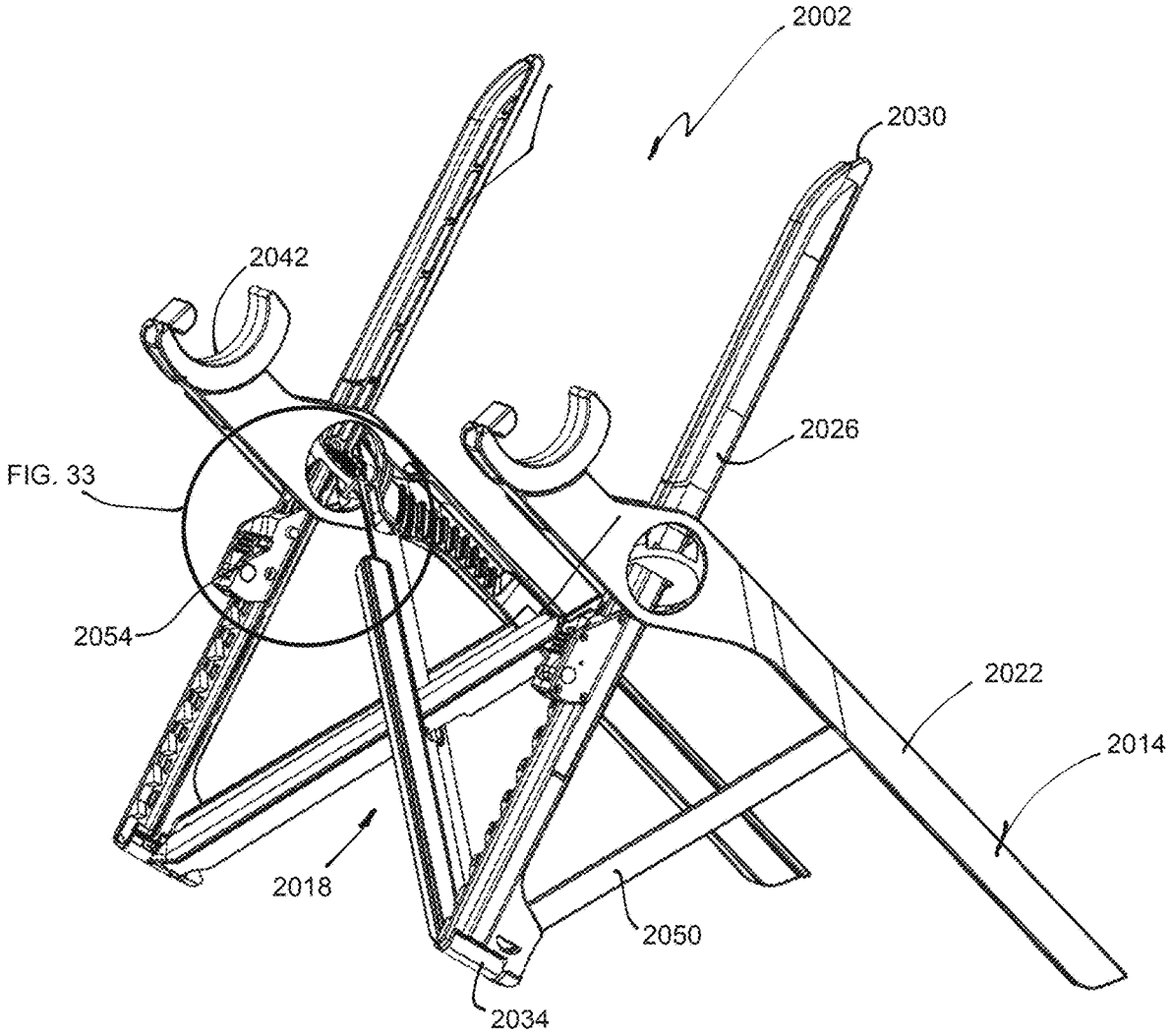
FIG. 28 is a front perspective view of another embodiment of the present invention.
Figure 29:
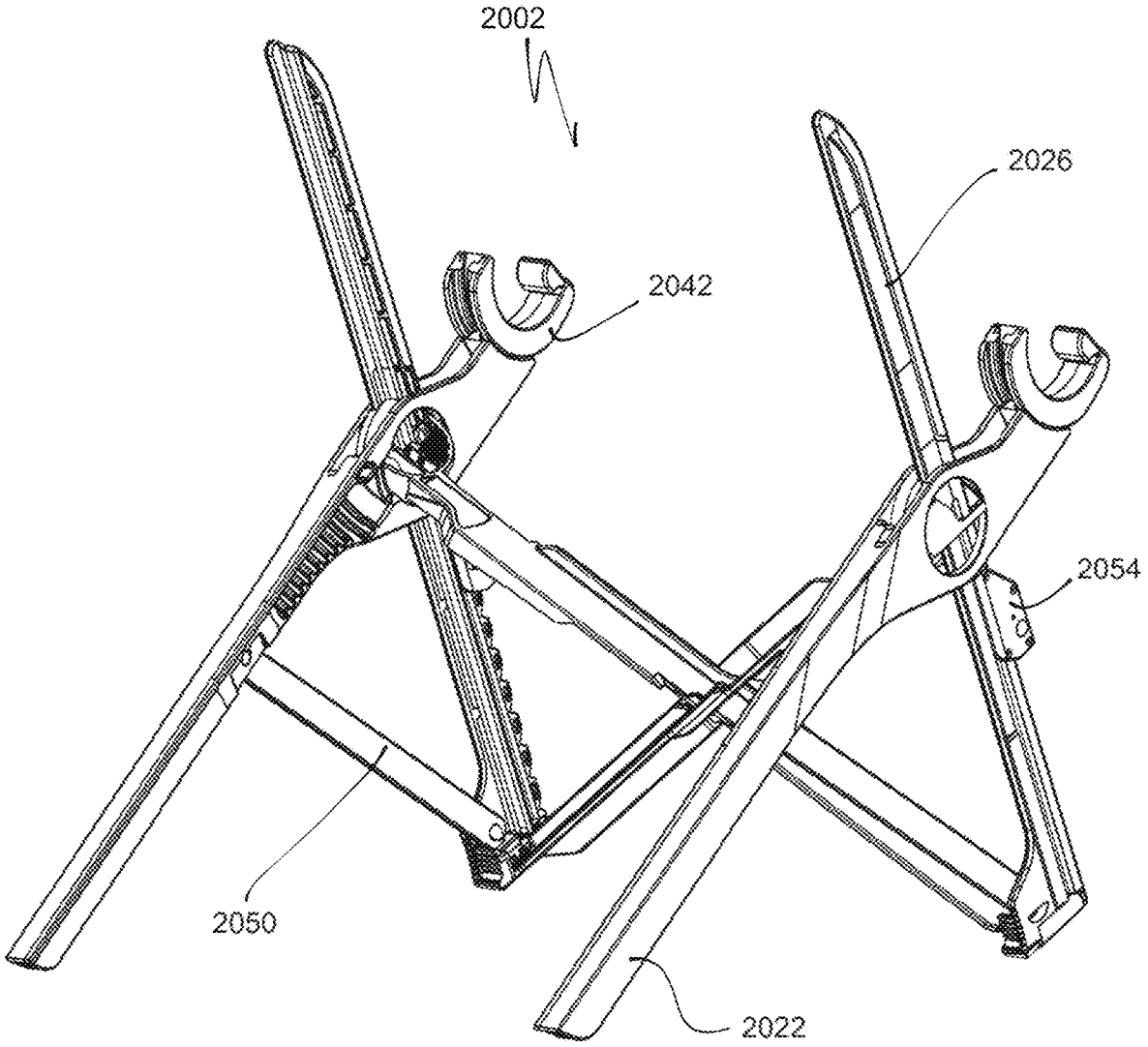
FIG. 29 is a rear perspective view of the embodiment shown in FIG. 28.
Figure 30:
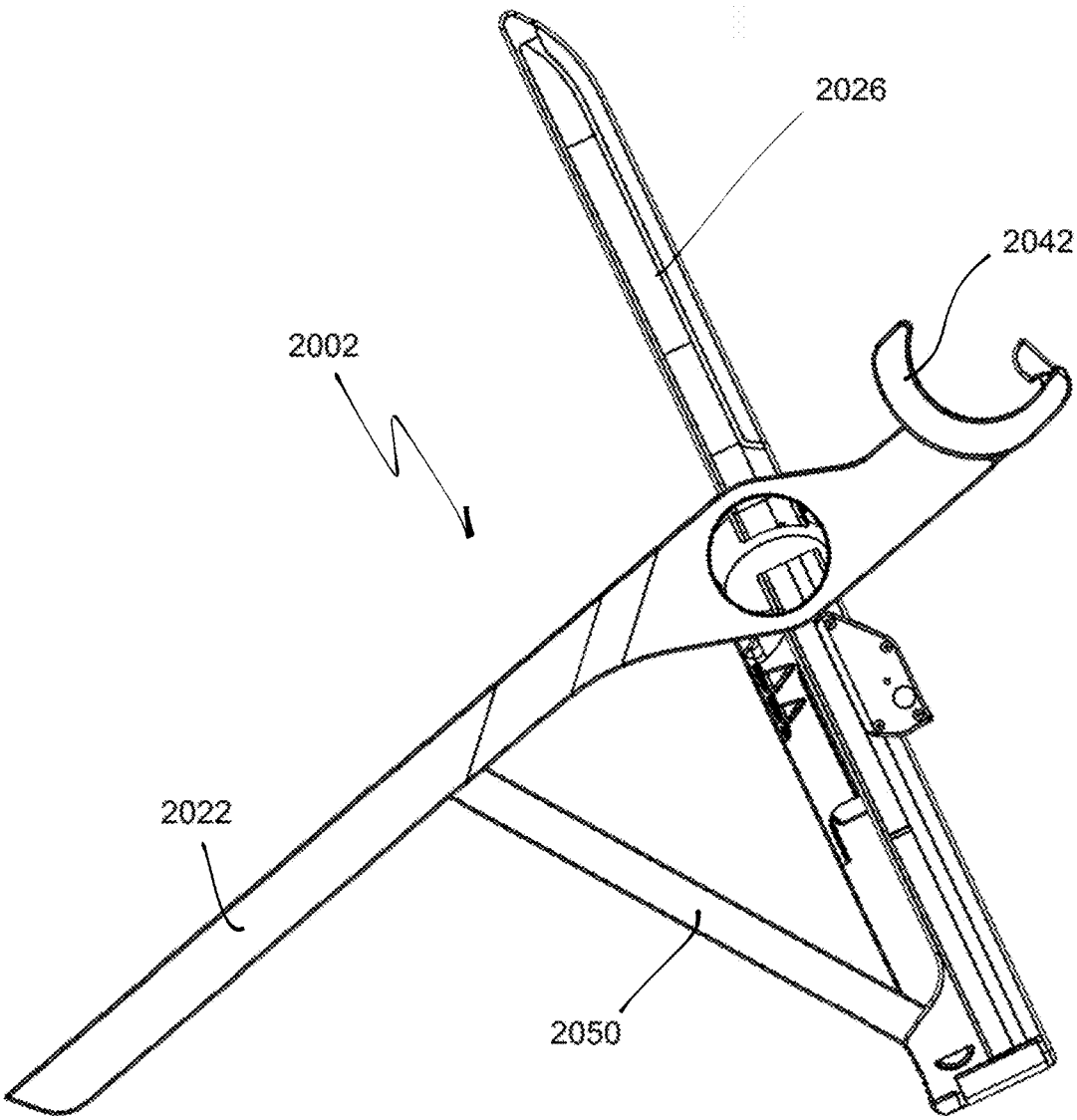
FIG. 30 is a side elevation view of the embodiment shown in FIG. 28.

FIGS. 25-27 show a stand 1002 of another embodiment of the present invention that employs an alternate height adjustment mechanism 1054. FIG. 25 shows the stand 1002 and a collapsed configuration wherein corresponding height adjustment mechanism 1054 are engaged or selectively interconnected. The height adjustment mechanism 1054 of this embodiment is biased in the direction of Arrow F by a spring member 1500, for example. When positions in a closed position, as shown in FIG. 27, inwardly-extending detents (not shown) interconnected to an inner surface(s) of the height adjustment mechanism's 1054 sidewall 1504 are engaged within a locking cavity 1508 provided in the arms 1026. Once locked in place, an upper surface 1512 will arrest motion of the legs 1022 to as described above.

Unlocking the height adjustment mechanism 1054 is achieved by the application of pressure in the direction of Arrow G on to finger grooves 1516 provided on the height adjustment mechanisms 1054, which urges an upper portion 1520 of the height adjustment mechanism in the direction opposite to Arrow F. Once the locking detents are removed from the locking cavity 1508, the height adjustment mechanism 1054 is capable of movement along a channel 1524 provided in the outer surface of the leg 1026. One of ordinary skill in the art will appreciate that a corresponding channel may be provided in the inner surface of the leg and corresponding inwardly-disposed arcing cavities may be provided.

Figure 31:
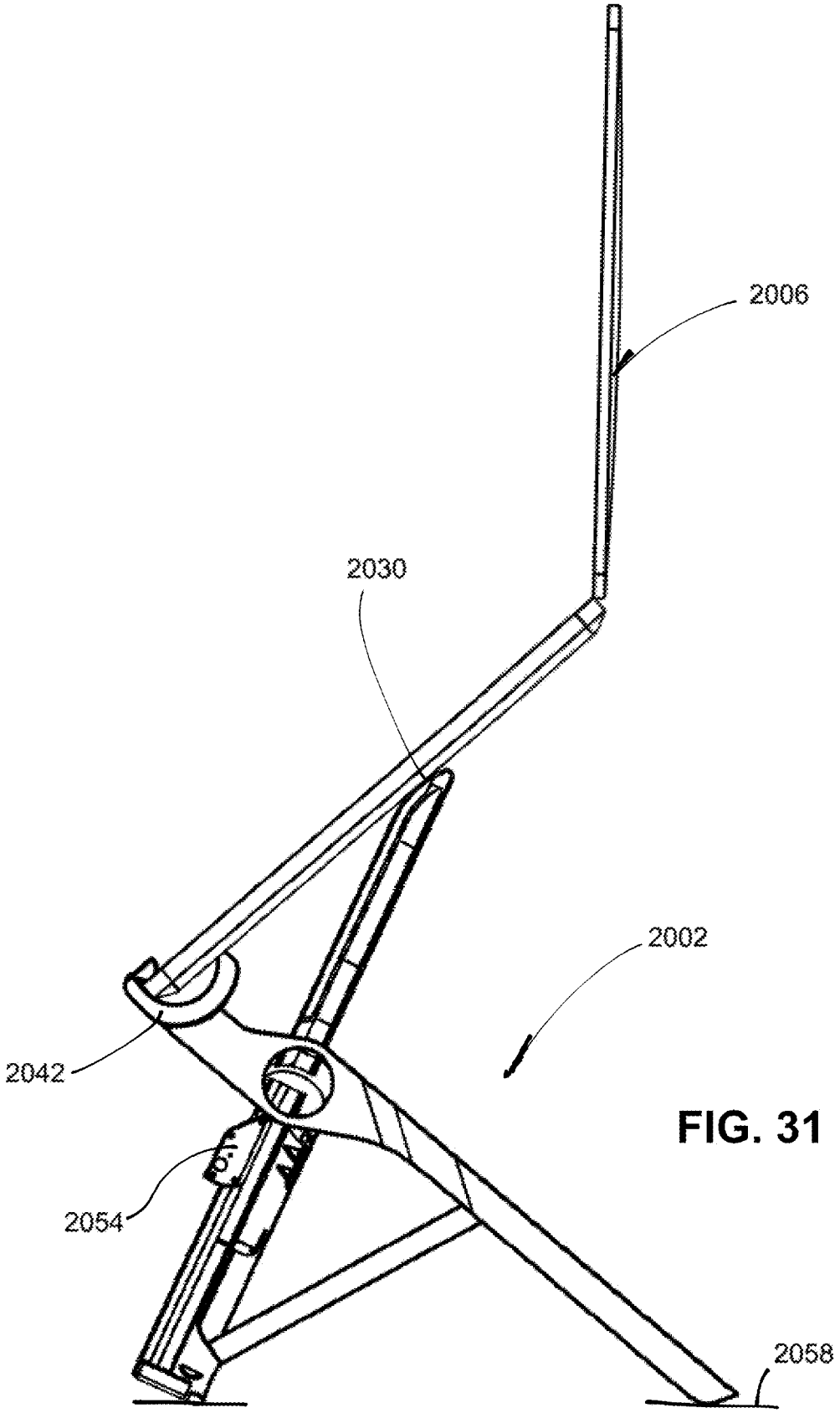
FIG. 31 is a right elevation view of the stand of FIG. 28 positioned at the first height.
Figure 32:
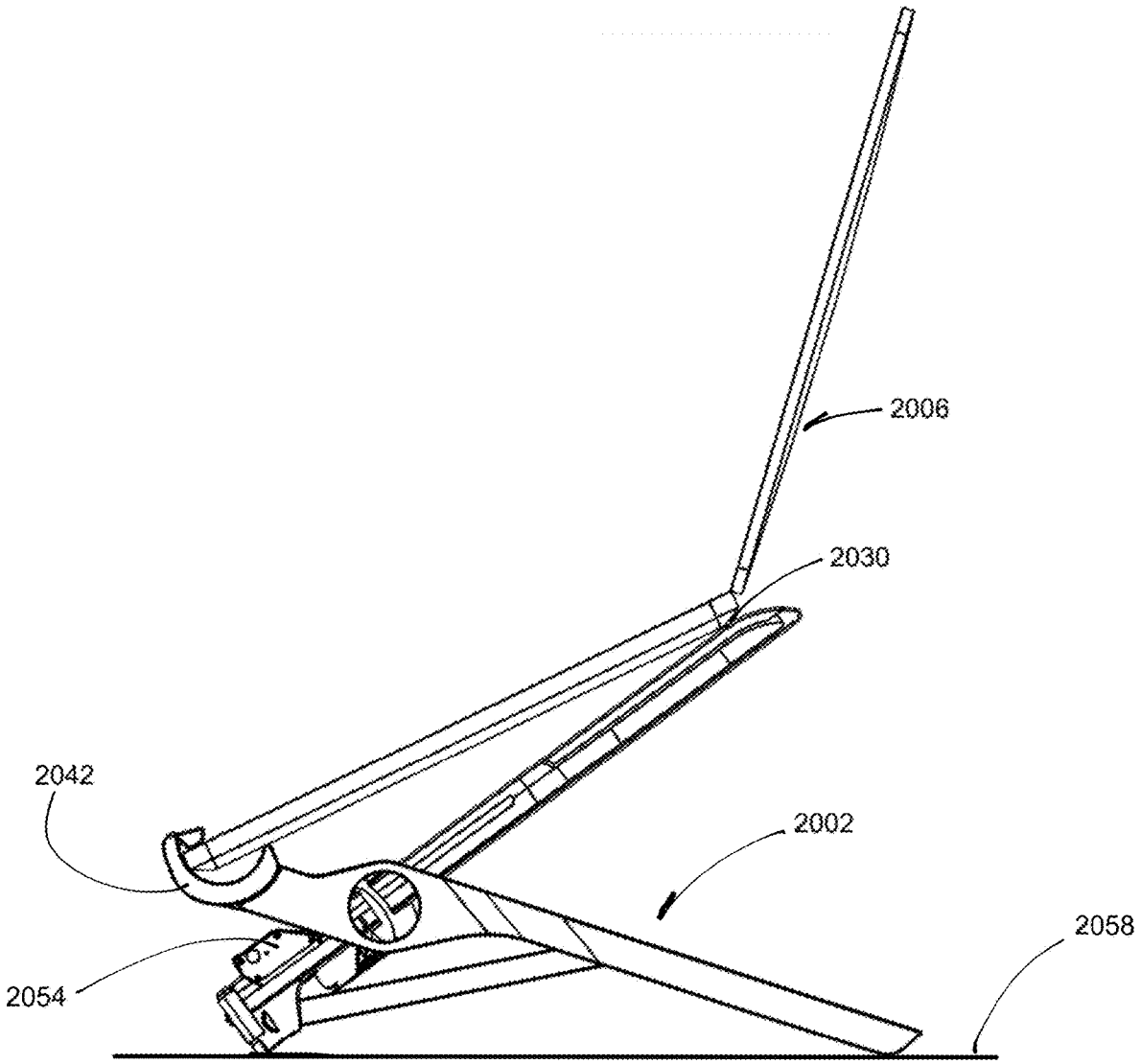
FIG. 32 is a right elevation view of the stand of FIG. 28 positioned at a second height.

FIGS. 28-36 show a stand 2002 of another embodiment of the present invention that shares a majority of the features and components employed by the embodiment of FIGS. 1-21, wherein an alternate height adjustment mechanism 2054 is employed. The stand 2002 generally consists of opposing side frame structures 2014 interconnected by a cross frame structure 2018 consists of cross frame members 2020. The side frame structures comprise a leg 2022 and arm 2026. The arm 2026 includes a first end with an engagement surface 2030 configured to receive the screen of the laptop computer and a second end that forms at least a portion of a base segment 2034 configured to rest on a flat surface. The leg 2022, which is slidingly and rotatably associated with the arm 2026, includes an upper end that accommodates a gripping mechanism 2042 and a second end that acts as a foot configured to engage the flat surface. The gripping mechanism 2042 is adapted to engage and secure a front edge of the laptop computer 2006. The leg 2022 is further interconnected to the base segment 2034 of the arm 2026 by a cross link 2050 to add stability to the expanded stand. In addition, some embodiments of the present invention are equipped with height adjusting functionality. Here, a height adjustment and maintaining mechanism 2054 (hereinafter "height adjustment mechanism") is operatively interconnected to the arms 2026, which will be described in further detail below. As shown in FIGS. 31 and 32, movement of the height adjustment mechanism 2054 along the length of the arms 2026 will alter the vertical distance between the gripping mechanism 2042 and the flat surface 2058 supporting the stand 2002, thereby altering the height of the laptop computer 2006.

Figure 33:
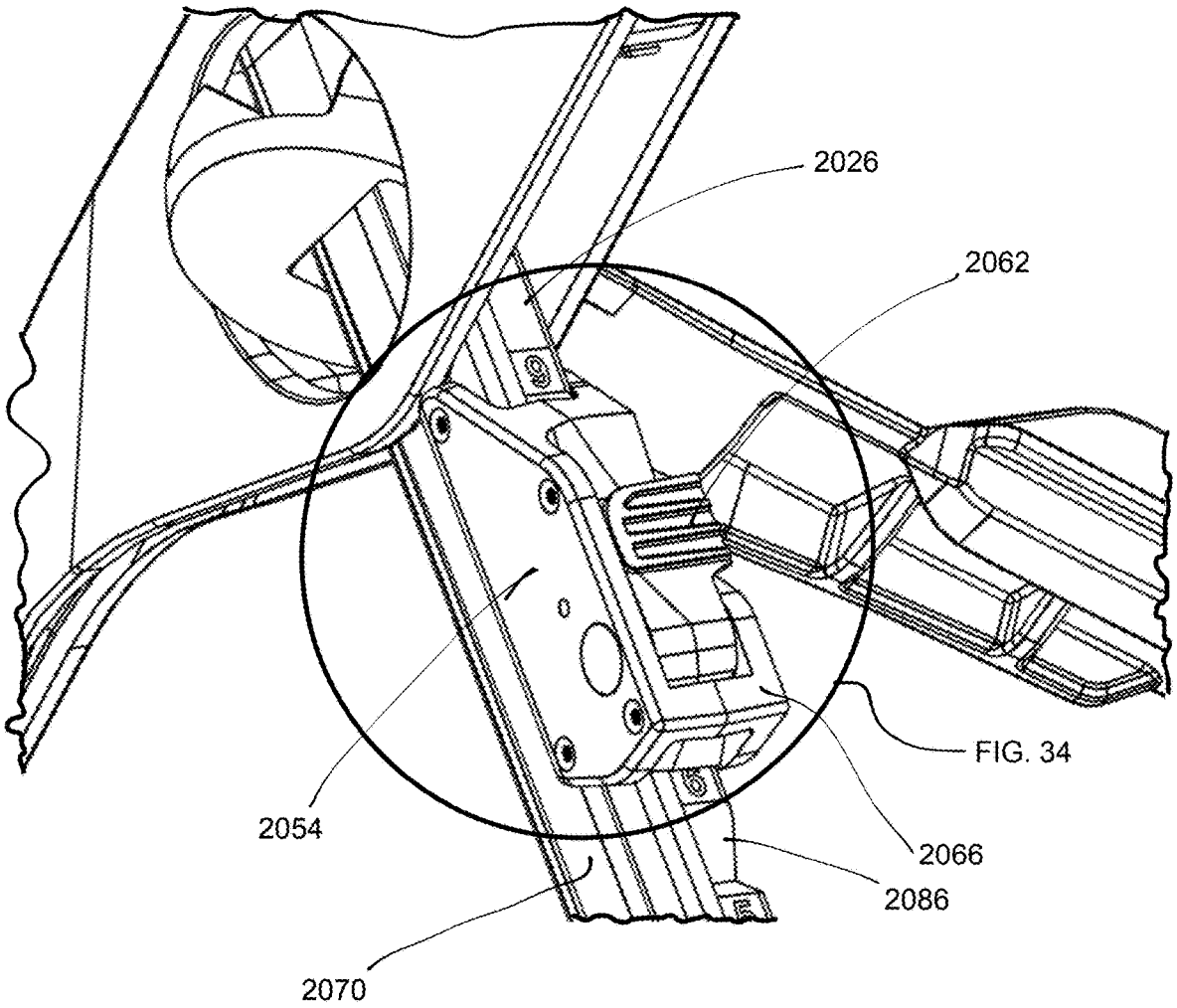
FIG. 33 is a detailed view showing a height adjusting and maintaining mechanism of one embodiment of the present invention.
Figure 34:
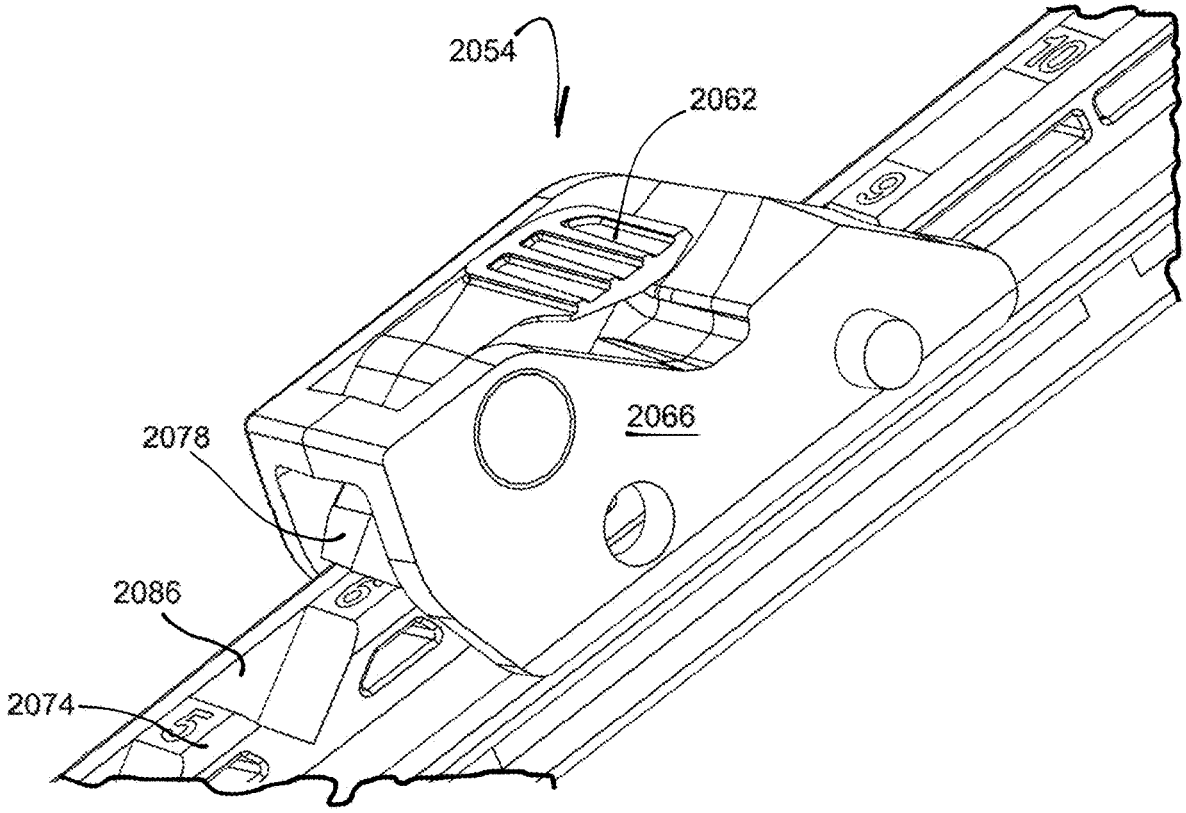
FIG. 34 is another detailed view showing a height adjusting and maintaining mechanism of one embodiment of the present invention.

FIGS. 33 and 34 show the height adjustment mechanism 2054 of one embodiment of the present invention comprising a lock 2062 operatively interconnected to a carrier 2066. The height adjustment mechanism 2054 is associated with at least one channel 2070 integrated into the arms 2026 of each side frame structure. The channel includes a plurality of teeth 2074 that selectively interface with a spring-biased locking protrusion 78 of the lock 2062. In operation, pressure on the lock 2062 will move the locking protrusion from a cavity 2086 provided between the teeth. The cavities 2086 may have angled or arcuate surfaces to facilitate carrier movement.

Figure 35:
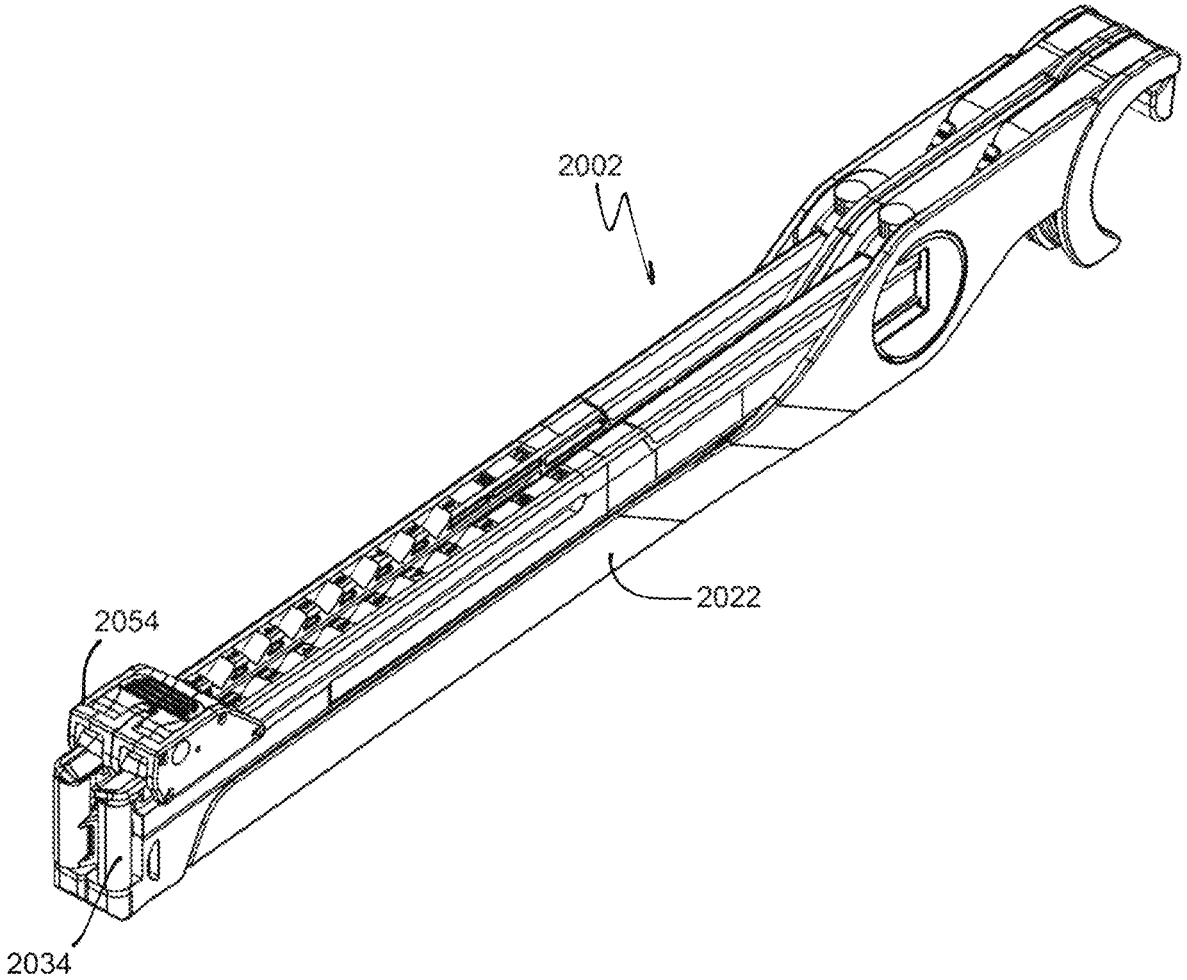
FIG. 35 is a front perspective view showing the stand of FIG. 28 in a collapsed position of use.
Figure 36:
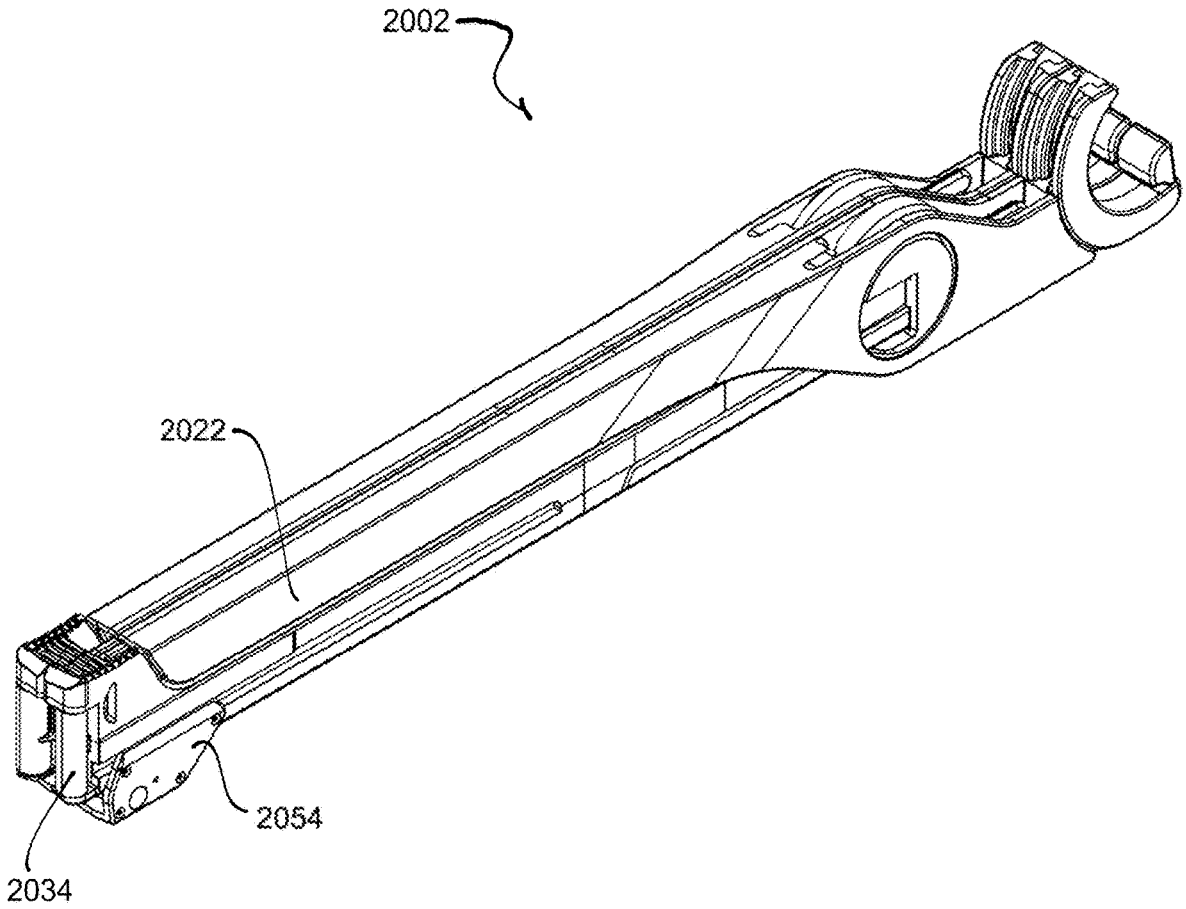
FIG. 36 is a rear perspective view showing the stand of FIG. 28 in the collapsed position of use.
Figure 37:
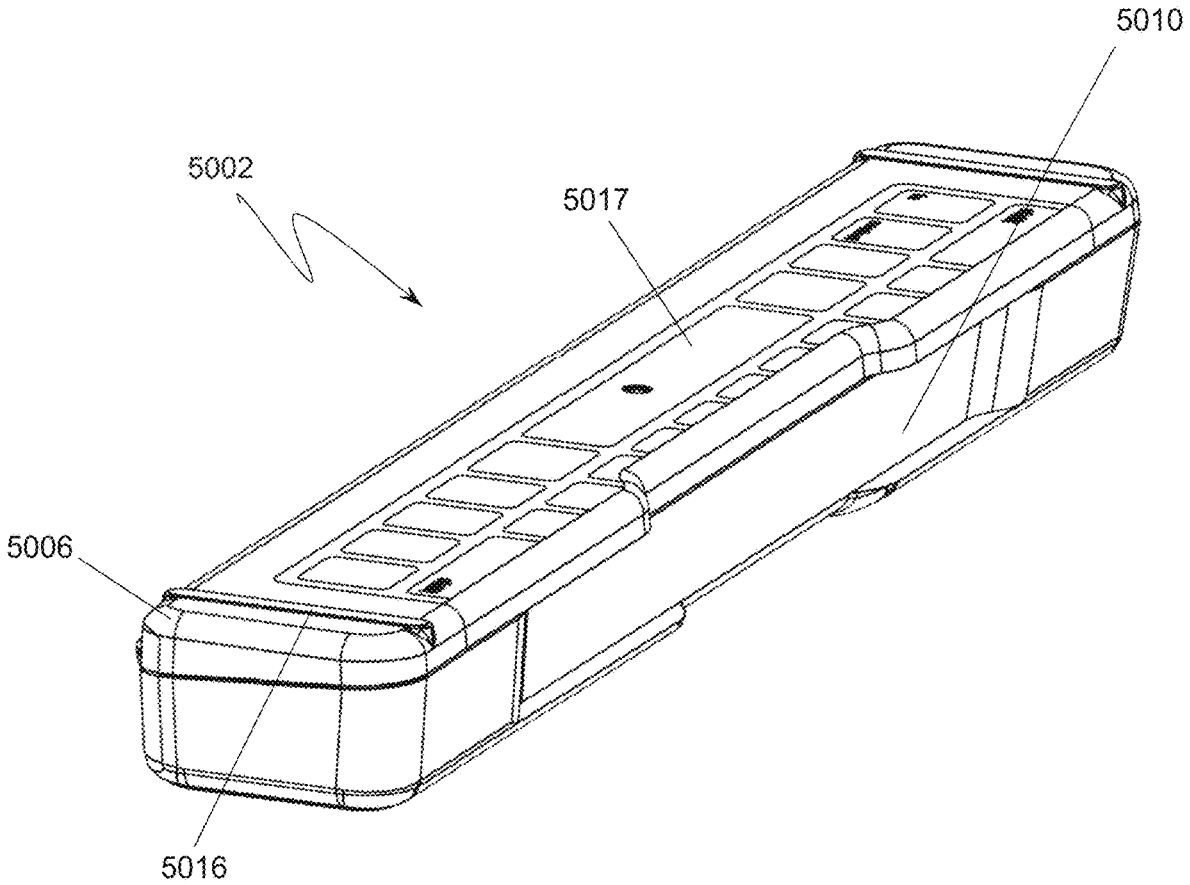
FIG. 37 is a perspective view showing a case for storing a collapsible stand of one embodiment of the present invention in a first, closed configuration.
Figure 38:
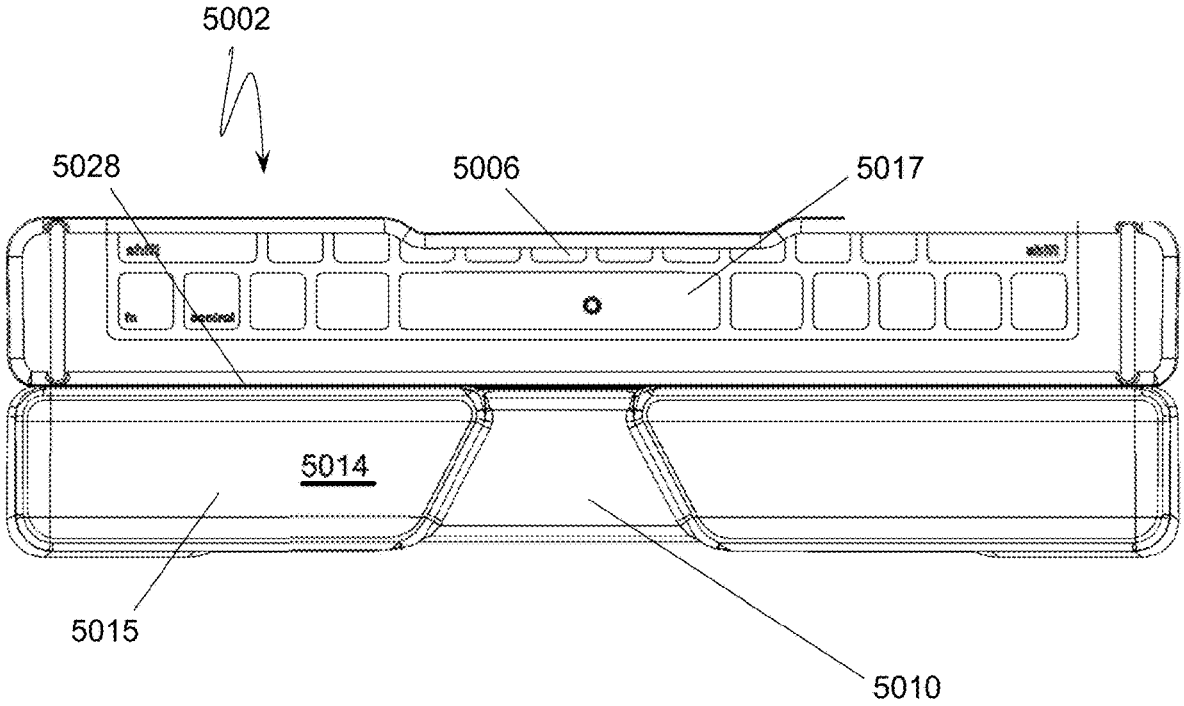
FIG. 38 is a bottom plan view of FIG. 37, wherein the case is in a second, open configuration.
Figure 39:
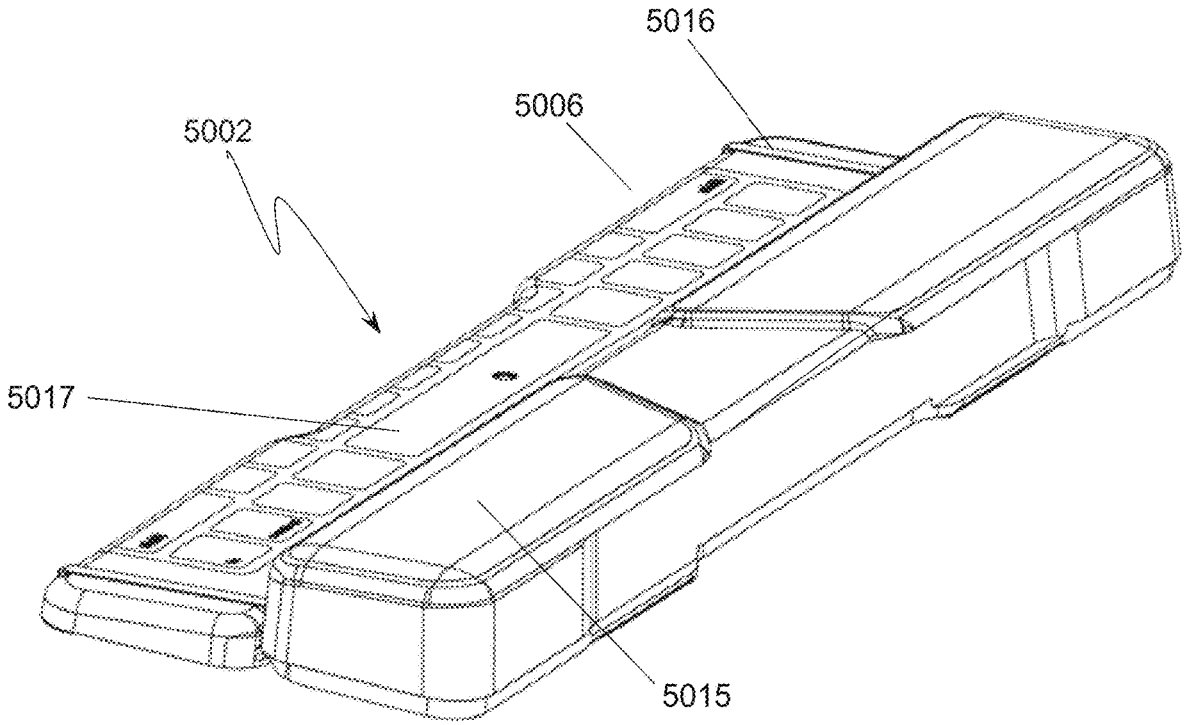
FIG. 39 is a perspective view showing a case for storing a collapsible stand of one embodiment of the present invention in a second, open configuration
Figure 40:
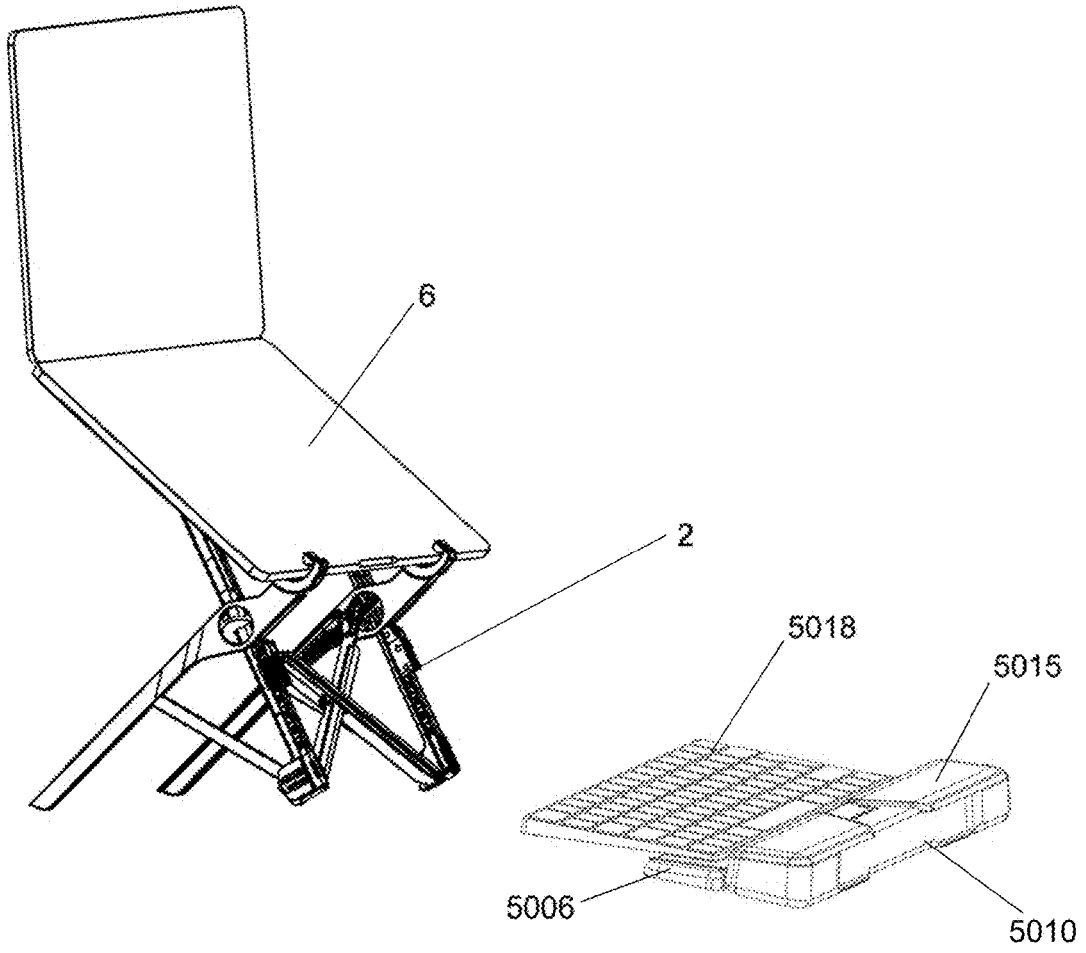
FIG. 40 is a perspective view showing the system of one embodiment comprising a stand supporting a laptop and an interconnected keyboard (here, a wireless keyboard) supported by the case in the second position of use.
Figure 41:
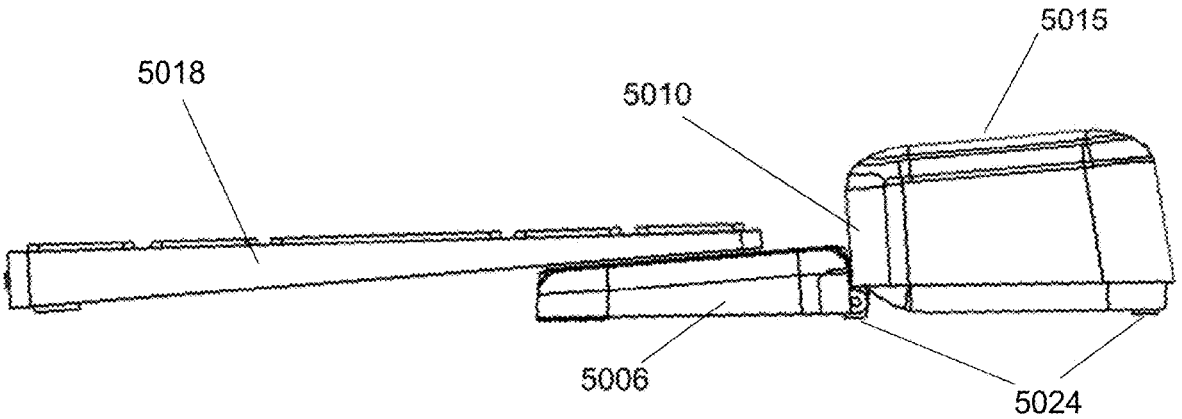
FIG. 41 is a side elevation view of a keyboard engaged onto the case of one embodiment of the present invention.
Figure 42:
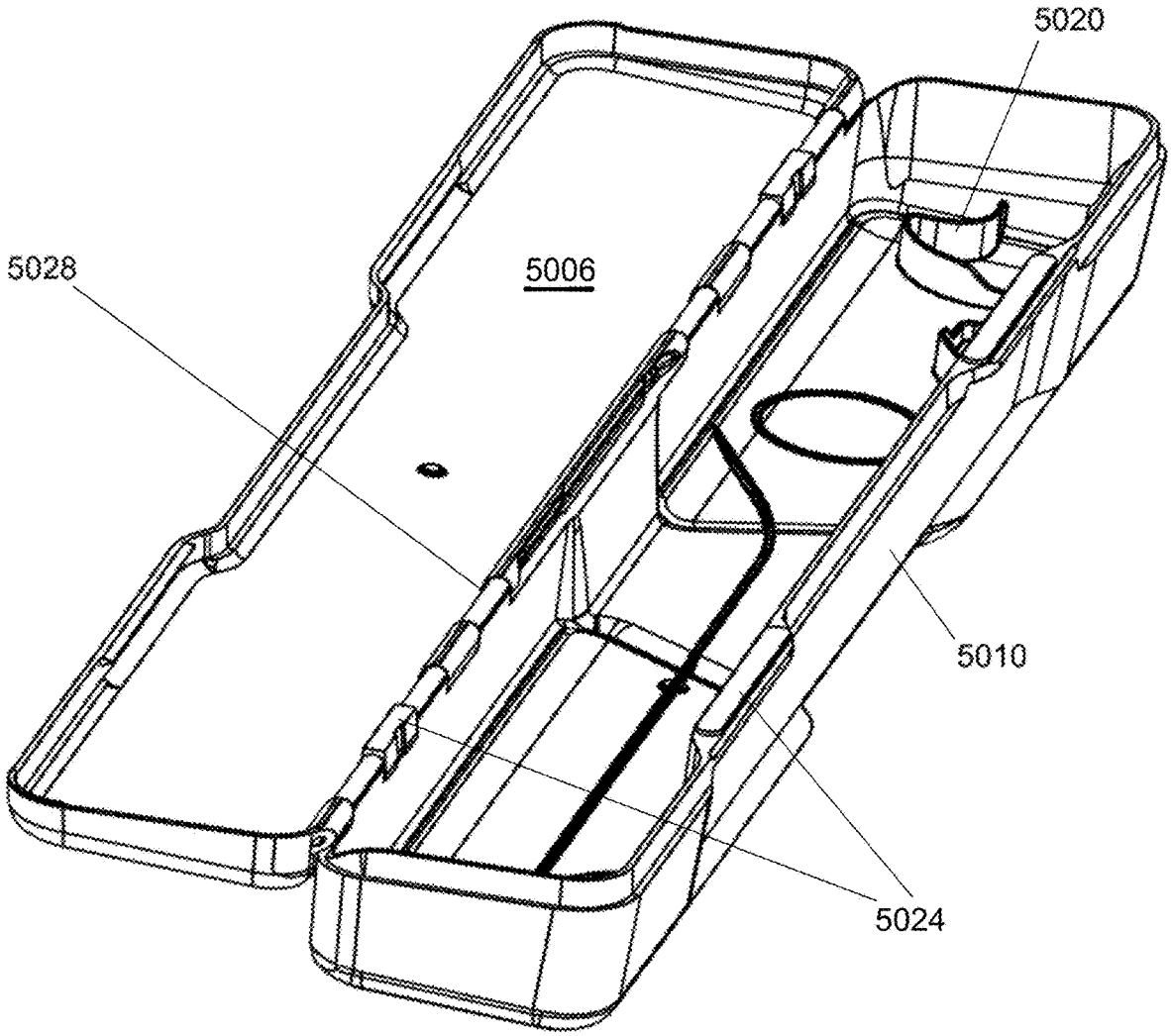
FIG. 42 is a perspective view showing the case interior.
Figure 43:
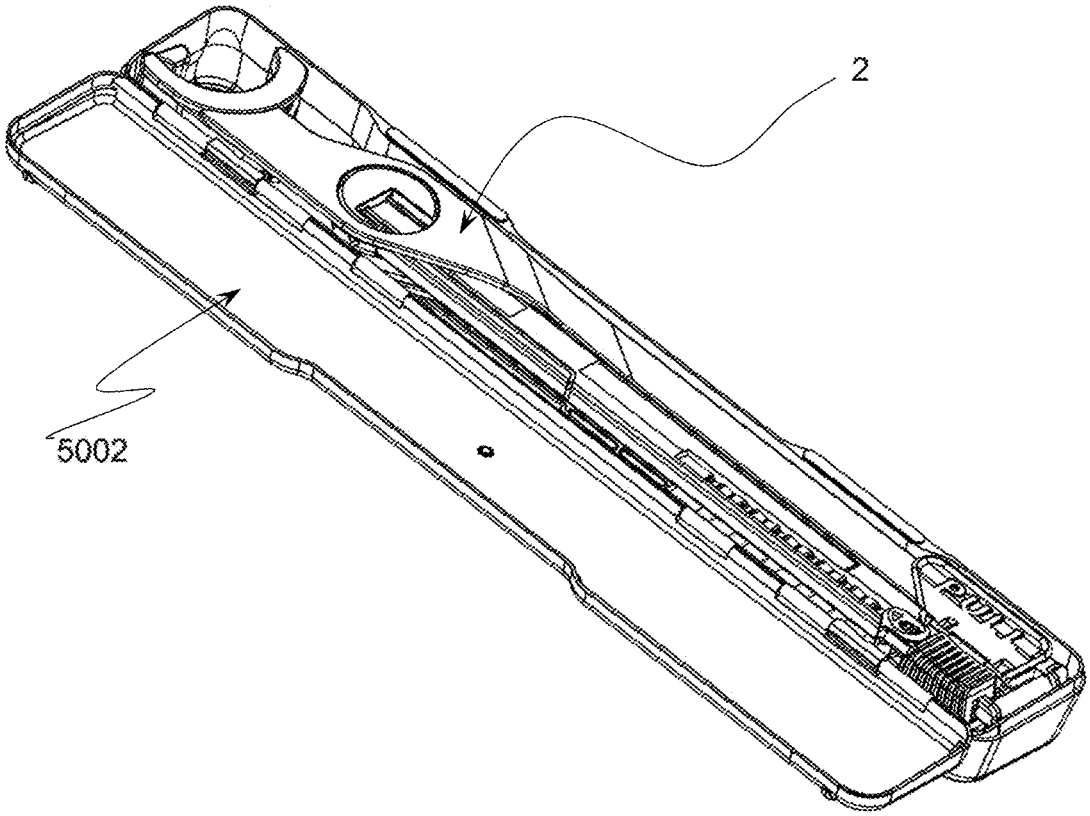
FIG. 43 is a perspective view showing a collapsed stand stored in the case.
Figure 44:
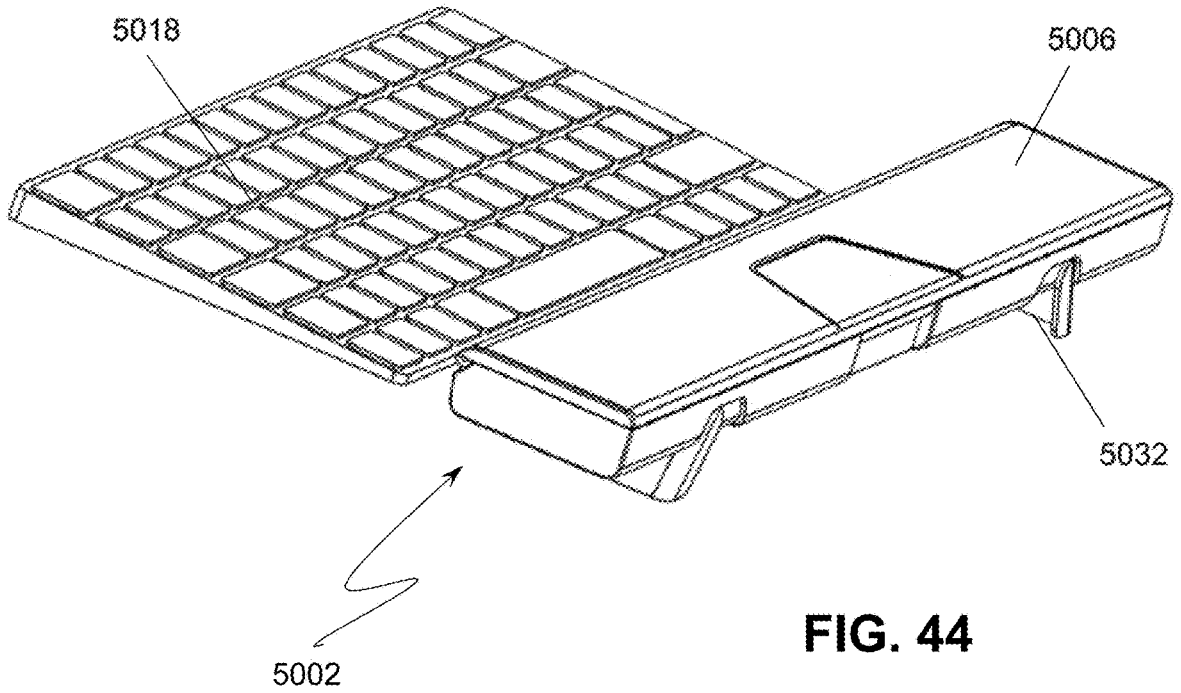
FIG. 44 is a perspective view showing a case of another embodiment of the present invention that possesses selectively deployable legs.
Figure 45:
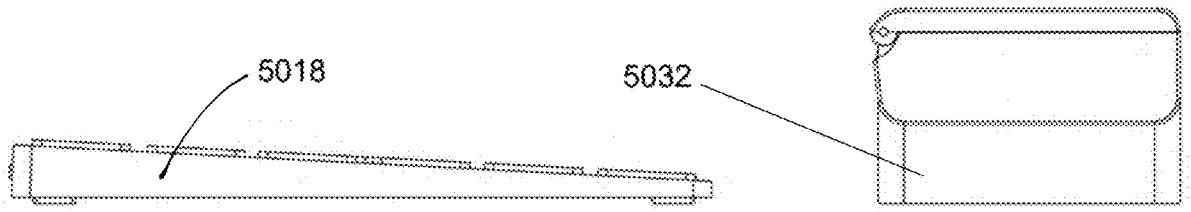
FIG. 45 is a side elevation view of FIG. 44.
Figure 46:
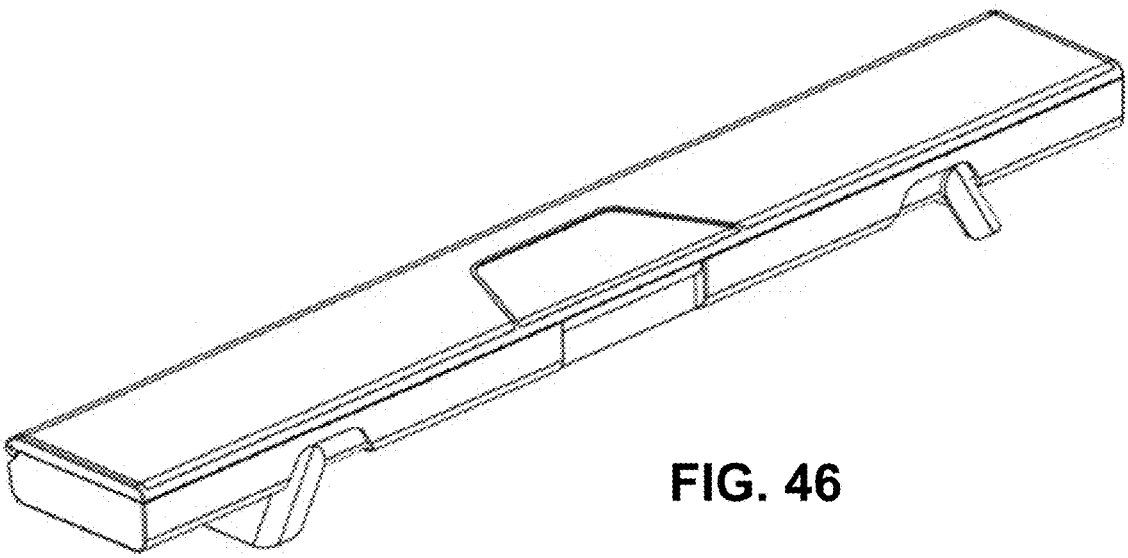
FIG. 46 is a top perspective view of the case of FIG. 44 with legs deployed.
Figure 47:
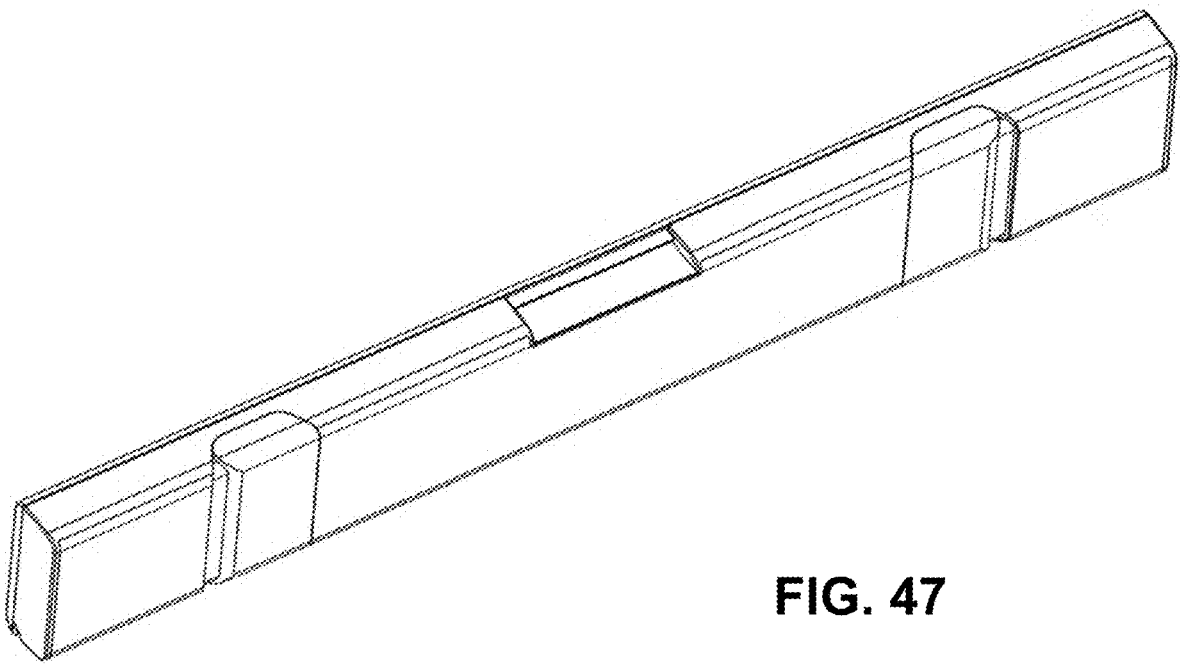
FIG. 47 is a bottom perspective view of the case of FIG. 44 with legs folded.

FIGS. 35 and 36 show the stand 2002 in a collapsed configuration, wherein corresponding height adjustment mechanism 2054 are engaged or selectively interconnected.

FIGS. 37-47 show a case 5002 of one embodiment of the present invention used to store a collapsible stand. The case 5002 includes a lid 5006 hingedly interconnected to a storage compartment 5010. The case 5002 is capable of a first position of use shown in FIG. 37 and a second position of use shown in FIG. 38, wherein the case 5002 is flipped to expose a bottom surface 5014 thereof, which acts as a wrist rest 5015. In the configuration shown in FIG. 39, the lid's outer surface becomes a base configured to fit beneath a keyboard to ergonomically elevate a portion thereof closer to the user. A protrusion is provided that helps seat the keyboard on the lid. In addition, some users may prefer using embodiments of the present invention in the closed configuration where the lid is not used to support the keyboard 518 and where the wrist rest is spaced from the keyboard edge. When in the closed configuration, the protrusions (which can incorporate a gripping surface) will enhance case/desk engagement. Ridges 5020 that generally correspond to the shape of the stand may be included. Grips 5024 that prevent or reduce slipping when the case is used in the second configuration of use shown in FIG. 41 may be provided. A hinge 5028, but other interconnection means are contemplated. For example, magnetic interconnection can be employed that would allow the lid to be selectively disconnected from the storage compartment, thereby allowing the keyboard to be spaced from the wrist rest.

FIGS. 44-47 show a case similar to that described above that further includes foldable legs 5032. In one embodiment, second legs of an alternate length are provided, wherein the user can use the first set of legs to define a first keyboard angle and a second set of legs to define a second keyboard angle. One of skill in the art will appreciate additional legs may be provided and/or leg length may be selectively adjustable.

Exemplary characteristics of embodiments of the present invention have been described. However, to avoid unnecessarily obscuring embodiments of the present invention, the preceding description may omit several known apparatus, methods, systems, structures, and/or devices one of ordinary skill in the art would understand are commonly included with the embodiments of the present invention. Such omissions are not to be construed as a limitation of the scope of the claimed invention. Specific details are set forth to provide an understanding of some embodiments of the present invention. It should, however, be appreciated that embodiments of the present invention may be practiced in a variety of ways beyond the specific detail set forth herein.

Modifications and alterations of the various embodiments of the present invention described herein will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. That is, the embodiments of the invention described herein are capable of being practiced or of being carried out in various ways. The scope of the various embodiments described herein is indicated by the following claims rather than by the foregoing description. And all changes which come within the meaning and range of equivalency of the claims are to be embraced within their scope. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The foregoing disclosure is not intended to limit the invention to the form or forms disclosed herein. In the foregoing Detailed Description, for example, various features of the invention are grouped together in one or more embodiments for the purpose of streamlining the disclosure. This method of disclosure is not to be interpreted as reflecting an intention that the claimed inventions require more features than expressly recited. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention. Further, the embodiments of the present invention described herein include components, methods, processes, systems, and/or apparatus substantially as depicted and described herein, including various sub-combinations and subsets thereof. Accordingly, one of skill in the art will appreciate that would be possible to provide for some features of the embodiments of the present invention without providing others. Stated differently, any one or more of the aspects, features, elements, means, or embodiments as disclosed herein may be combined with any one or more other aspects, features, elements, means, or embodiments as disclosed herein.

The invention claimed is:

1. A stand for supporting a computing device, comprising:

a first side frame structure including a first elongate frame member and a second elongate frame member, the second elongate frame member attached to the first elongate frame member such that the second elongate frame member is operatively movable relative to the first elongate frame member and operatively movable along a length of the first elongate frame member;

a second side frame structure including a third elongate frame member and a fourth elongate frame member, the fourth elongate frame member attached to the third elongate frame member such that the fourth elongate frame member is operatively movable relative to the third elongate frame member and operatively movable along a length of the third elongate frame member;

a first cross frame member having a first end operatively associated with the first elongate frame member and the second elongate frame member and a second end operatively interconnected of a base segment of the third elongate frame member;

a second cross frame member having a first end operatively associated with the third elongate frame member and the fourth elongate frame member and a second end operatively interconnected of a base segment of the first elongate frame member;

wherein the first cross frame member is operatively interconnected to the second cross frame member, wherein the first cross frame member and second cross frame member are configured to operatively move relative to each other when the first side structure and second side structure are moved apart to configure the stand in an expanded position of use, and wherein the first cross frame member and second cross frame member are configured to operatively move relative to each other when the first side structure and second side structure are moved together to configure the stand in a collapsed position of use;

a height adjustment member operatively interconnected to the first elongate frame member, the height adjustment member configured to operatively move along a portion of the first elongate frame member and selectively engage and fixedly interconnect to a predetermined location on the first elongate frame member, and wherein the height adjustment member has a surface configured to engage a portion of the second elongate member when the stand is positioned in the expanded position of use; and wherein the height adjustment member has at least one inwardly-extending detent that is selectively biased towards the first frame member.

2. The stand of claim 1, wherein the height adjustment member operatively moves along a channel provided in the first elongate frame member, wherein cavities configured to receive the at least one inwardly-extending detent are defined as spaces between a plurality of teeth provided in the channel, and wherein the at least one inwardly detent is operatively interconnected to a carrier and configured to be received within at least one cavity when biased inwardly towards the first elongate frame member by a lock operatively interconnected to the carrier.

3. The stand of claim 1, wherein the height adjustment member is a first height adjustment member, and further comprising a second height adjustment member operatively interconnected to the third elongate frame member, the second height adjustment member configured to operatively move along a portion of the third elongate frame member, the second height adjustment member configured to selectively engage and fixedly interconnect to a predetermined location on the third elongate frame member, and wherein the second height adjustment member has a surface configured to engage a portion of the fourth elongate member when the stand is positioned in the expanded position of use; and wherein the second height adjustment member has at least one inwardly-extending detent that is selectively biased towards the third frame member.

4. The stand of claim 1, wherein the second elongate member has a first opening that operatively receives a head of the first cross member and a second opening that the first elongate frame member passes through;

wherein the fourth elongate member has a third opening that operatively receives a head of the second cross member and a fourth opening that the third elongate frame member passes through;

wherein the head of the first cross member comprises an outer profile that operatively interfaces with a corresponding profile provided in the first opening;

wherein the head of the second cross member comprises an outer profile that operatively interfaces with a corresponding profile provided in the third opening;

wherein the head of the first cross member further comprises a fifth opening that the first elongate frame member passes through; and wherein the head of the second cross member further comprises a sixth opening that the first elongate frame member passes through.

5. The stand of claim 4, wherein the head of the first cross member further comprises an outer surface that is flush with an outer surface of the second elongate frame member when the stand is in the collapsed configuration of use, and wherein the head of the second cross member further comprises an outer surface that is flush with an outer surface of the fourth elongate frame member when the stand is in the collapsed configuration of use.

6. The stand of claim 1, wherein second and fourth elongate frame members include internal surfaces that contact each other when the stand is in the collapsed configuration of use to conceal at least a portion of rear surfaces of the first and second cross members.

7. The stand of claim 1, wherein:

the first side frame structure further includes a first cross link member operatively attached at a first end to the first elongate frame member and at a second end to the second elongate frame member; and the second side frame structure further includes a second cross link member operatively attached at a first end to the third elongate frame member and at a second end to the fourth elongate frame member.

8. The stand of claim 1, further including a first tab interconnected to the base segment of the first elongate frame member, and a second tab interconnected to the base segment of the third elongate frame member.

9. The stand of claim 8, wherein the first and second tabs are biased against corresponding outer surfaces of first and second elongate frame members.

10. The stand of claim 1, wherein the second elongate member and the fourth elongate member each include a gripping mechanism adapted to selectively engage a portion of the computing device.

11. A stand for supporting a computing device above a support surface, the stand comprising:

a first side frame structure including a first elongate frame member and a second elongate frame member, the second elongate frame member attached to the first elongate frame member such that the second elongate frame member is operatively movable relative to the first elongate frame member and is operatively movable along a length of the first elongate frame member;

a second side frame structure including a third elongate frame member and a fourth elongate frame member, the fourth elongate frame member attached to the third elongate frame member such that the fourth elongate frame member is operatively movable relative to the third elongate frame member and is operatively movable along a length of the third elongate frame member;

operatively interconnected cross frame members interconnecting the first side frame structure to the second side frame structure, wherein the cross frame members rotate relative to each other when the first side frame structure and second side frame structure are moved apart to configure the stand in an expanded position of use and moved together to configure the stand in a collapsed position of use;

a height adjustment member operatively interconnected to the first elongate frame member, the height adjustment member configured to operatively move along a portion of the first elongate frame member, the height adjustment member configured to selectively engage and fixedly interconnect to a predetermined location on the first elongate frame member, and wherein the height adjustment member has a surface configured to engage a portion of the second elongate member when the stand is positioned in the expanded position of use; and wherein the height adjustment member moves along a channel provided in the first elongate frame member that includes a plurality of teeth, and wherein the height adjustment member is comprised of a carrier with at least one deflectable member ending in a protrusion configured to engage a space provided between adjacent teeth.

12. The stand of claim 11, further including a first tab interconnected to a base segment of the first elongate frame member, and a second tab interconnected to a base segment of the third elongate frame member.

13. The stand of claim 11, wherein the second elongate member and the fourth elongate member each include a gripping mechanism adapted to selectively engage a portion of the computing device, the gripping mechanisms including members configured to move in an arcuate path relative to the second elongate member and the fourth elongate member.

14. A stand for supporting a computing device above a support surface, the stand comprising:

a first side-frame structure including a first elongate frame member and a second elongate frame member, the second elongate frame member attached to the first elongate frame member such that the second elongate frame member is operatively movable relative to the first elongate frame member and is operatively movable along a length of the first elongate frame member, the second elongate frame member including an upper end portion that extends beyond the first elongate frame member, the upper end portion of the second elongate frame member and an upper end portion of the first elongate frame member are each configured to engage the computing device when the stand is in a fully-extended position;

a second side-frame structure including a third elongate frame member and a fourth elongate frame member, the fourth elongate frame member attached to the third elongate frame member such that the fourth elongate frame member is operatively movable relative to the third elongate frame member and is operatively movable along a length of the third elongate frame member, the fourth elongate frame member including an upper end portion that extends beyond the third elongate frame member, the upper end portion of the fourth elongate frame member and an upper end portion of the third elongate frame member are each configured to engage the computing device when the stand is in the fully-extended position;

a cross-frame structure positioned between the first and second side-frame structures, the cross-frame structure attached to the first and second side-frame structures such that the first and second side-frame structures are oriented substantially parallel to one another during collapse of the stand from the fully-extended position to a fully-collapsed position, wherein each of the first, second, third, and fourth elongate frame members is oriented at an oblique angle relative to the support surface when the stand is in the fully-extended position;

the improvement comprising:

a height adjustment member operatively interconnected to the first elongate frame member, the height adjustment member configured to operatively move along a portion of the first elongate frame member, the height adjustment member configured to selectively engage and fixedly interconnect to a predetermined location on the first elongate frame member, and wherein the height adjustment member is operatively movable along the first elongate member, has a surface configured to engage a portion of the second elongate member when the stand is positioned in the fully-extended position, and a deflectable member configured to selectively engage a portion of the first elongate member.

15. The stand of claim 14, further including a first tab interconnected to a base segment of the first elongate frame member, and a second tab interconnected to the base segment of a third elongate frame member.

16. The stand of claim 14, wherein the second elongate member and the fourth elongate member each include a gripping mechanism adapted to selectively engage a portion of the computing device, the gripping mechanisms including members configured to move in an arcuate path relative to the second elongate member and the fourth elongate member.

* * * * *